US009262956B2

(12) United States Patent
Jeong et al.

(10) Patent No.: US 9,262,956 B2
(45) Date of Patent: Feb. 16, 2016

(54) DISPLAY DEVICE, DATA PROCESSING APPARATUS, AND RELATED METHOD

(71) Applicant: Samsung Display Co., Ltd., Yongin, Gyeonggi-Do (KR)

(72) Inventors: Geun-Young Jeong, Yongin (KR); Ji-Yeon Yang, Yongin (KR); Byung-Hyun Kim, Yongin (KR); Takeshi Kato, Yongin (KR); Myung-Ho Lee, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 201 days.

(21) Appl. No.: 14/161,077

(22) Filed: Jan. 22, 2014

(65) Prior Publication Data

US 2015/0015590 A1 Jan. 15, 2015

(30) Foreign Application Priority Data

Jul. 15, 2013 (KR) ..... 10-2013-0083011

(51) Int. Cl.
*G09G 1/00* (2006.01)
*G09G 3/20* (2006.01)

(52) U.S. Cl.
CPC ..... *G09G 3/2003* (2013.01); *G09G 2300/0452* (2013.01); *G09G 2340/06* (2013.01)

(58) Field of Classification Search
CPC ..... G09G 1/00; G09G 2300/0452; G09G 2340/06; G09G 2340/0457; G09G 3/2003; G09G 2320/0242; G09G 3/3607; G09G 5/02
See application file for complete search history.

(56) References Cited

U.S. PATENT DOCUMENTS

2012/0249610 A1* 10/2012 Katagami ..... G09G 3/3426 345/690
2013/0241946 A1 9/2013 Jeong et al.

FOREIGN PATENT DOCUMENTS

KR 10-2005-0059647 6/2005
KR 10-2011-0123531 11/2011
KR 10-2012-0052739 5/2012
KR 10-1146992 5/2012

* cited by examiner

*Primary Examiner* — Michael Faragalla
(74) *Attorney, Agent, or Firm* — Innovation Counsel LLP

(57) ABSTRACT

A data processing apparatus includes a diagonal detector, a first processor, and a second processor. The diagonal detector may determine whether a red-blue data set includes data for controlling a display device to display any diagonal line, the display device including subpixels arranged in first-type lines and second-type lines that are alternately disposed, the red-blue data set including 9 data values that correspond to 9 subpixels among the subpixels, the 9 subpixels forming a 3-by-3 array that includes a center subpixel, the 9 data values including a center data value that corresponds to the center subpixel. The first/second processor may process the center data value using a first/second coefficient to produce a first/second value that corresponds to the center subpixel if the center subpixel is in the first-type/second-type lines.

20 Claims, 23 Drawing Sheets

FIG. 11A

| | | |
|---|---|---|
| 1 | 0 | 0 |
| 0 | 1 | 0 |
| 0 | 0 | 1 |

FIG. 11B

| | | |
|---|---|---|
| 1 | 0 | 0 |
| 0 | 1 | 0 |
| 0 | 0 | 0 |

FIG. 11C

| | | |
|---|---|---|
| 0 | 0 | 0 |
| 1 | 0 | 0 |
| 0 | 1 | 0 |

FIG. 11D

| | | |
|---|---|---|
| 0 | 0 | 1 |
| 1 | 0 | 0 |
| 0 | 1 | 0 |

FIG. 11E

| | | |
|---|---|---|
| 0 | 0 | 0 |
| 0 | 1 | 0 |
| 0 | 0 | 1 |

FIG. 11F

| | | |
|---|---|---|
| 0 | 1 | 0 |
| 0 | 0 | 1 |
| 0 | 0 | 0 |

FIG. 11G

| | | |
|---|---|---|
| 0 | 1 | 0 |
| 0 | 0 | 1 |
| 1 | 0 | 0 |

FIG. 11H

| | | |
|---|---|---|
| 0 | 0 | 1 |
| 0 | 1 | 0 |
| 1 | 0 | 0 |

FIG. 11I

| | | |
|---|---|---|
| 0 | 0 | 1 |
| 0 | 1 | 0 |
| 0 | 0 | 0 |

FIG. 11J

| | | |
|---|---|---|
| 0 | 0 | 0 |
| 0 | 0 | 1 |
| 0 | 1 | 0 |

FIG. 11K

| | | |
|---|---|---|
| 1 | 0 | 0 |
| 0 | 0 | 1 |
| 0 | 1 | 0 |

FIG. 11L

| | | |
|---|---|---|
| 0 | 0 | 0 |
| 0 | 1 | 0 |
| 1 | 0 | 0 |

FIG. 11M

| | | |
|---|---|---|
| 0 | 1 | 0 |
| 1 | 0 | 0 |
| 0 | 0 | 0 |

FIG. 11N

| | | |
|---|---|---|
| 0 | 1 | 0 |
| 1 | 0 | 0 |
| 0 | 0 | 1 |

FIG. 11O

| | | |
|---|---|---|
| 0 | 1 | 0 |
| 1 | 0 | 1 |
| 0 | 1 | 0 |

FIG. 11P

| | | |
|---|---|---|
| 0 | 1 | 0 |
| 0 | 0 | 1 |
| 0 | 1 | 0 |

FIG. 11Q

| | | |
|---|---|---|
| 0 | 1 | 0 |
| 1 | 0 | 0 |
| 0 | 1 | 0 |

FIG. 11R

| | | |
|---|---|---|
| 0 | 0 | 0 |
| 1 | 0 | 1 |
| 0 | 1 | 0 |

FIG. 11S

| | | |
|---|---|---|
| 0 | 1 | 0 |
| 1 | 0 | 1 |
| 0 | 0 | 0 |

DISPLAY DEVICE, DATA PROCESSING APPARATUS, AND RELATED METHOD

CROSS-REFERENCE TO RELATED APPLICATION

This application claims priority to and the benefit of Korean Patent Application No. 10-2013-0083011 filed in the Korean Intellectual Property Office on Jul. 15, 2013, the entire contents of which are incorporated herein by reference.

BACKGROUND (a) Field

The present invention is related to a display device, a data processing apparatus, and a method pertaining to at least one of the display device and the data processing apparatus.

(b) Description of the Related Art

A display device may include pixels each having four subpixels. The display device may operate in an 8 color mode in which 8 colors may be represented using on/off combinations of the subpixels. The 8 colors may be, for example, red, green, blue, yellow, cyan, magenta, white, and black.

The 8 color mode may reduce the power consumption of the display device. Nevertheless, the quality of the image displayed using the limited 8 colors may be unsatisfactory. The above information disclosed in this Background section is for enhancement of understanding of the background of the invention. The Background section may contain information that does not form the prior art that is already known in this country to a person of ordinary skill in the art.

SUMMARY

Embodiments of the present invention may minimize color distortion in a diagonal line displayed by a display device.

An embodiment of the present invention may be related to a data processing apparatus that may include a diagonal detector configured to determine whether a first red-blue data set includes data for controlling a display device to display any diagonal line that substantially overlaps or is substantially parallel to a diagonal of a display area of the display device.

The display device may include subpixels arranged in first-type subpixel lines and second-type subpixel lines. The first-type subpixel lines and second-type subpixel lines may be alternately disposed. A first-type subpixel line and a second-type subpixel line may respectively represent an odd-numbered subpixel row (or row pair) and an even-numbered subpixel row (or row pair), an even-numbered subpixel row (or row pair) and an odd-numbered subpixel row (or row pair), an odd-numbered subpixel column (or column pair) and or an even-numbered subpixel column (or column pair), or an even-numbered subpixel column (or column pair) and or an odd-numbered subpixel column (or column pair).

The first red-blue data set may include first 9 data values that correspond to first 9 subpixels among the subpixels. The first 9 subpixels may form a first 3-by-3 array and may include red subpixel and blue pixels. The first 3-by-3 array may include a first center subpixel located at center of the first 3-by-3 array, i.e., located at an intersection of a second (i.e., middle) row of the first 3-by-3 array and a second (i.e., middle) column of the first 3-by-3 array. The first 9 data values may include a first center data value that corresponds to the first center subpixel.

The data processing apparatus may further include a first processor configured to process the first center data value using a first coefficient to produce a first first-type line center data value that corresponds to the first center subpixel if the first center subpixel is in the first-type subpixel lines. The data processing apparatus may further include a second processor configured to process the first center data value using a second coefficient different from the first coefficient to produce a first second-type line center data value that corresponds to the first center subpixel if the first center subpixel is in the second-type subpixel lines. The data processing apparatus may further include hardware for performing one or more tasks associated with one of more of the diagonal detector, the first processor, and the second processor.

The data processing apparatus may include a third processor configured to process the first center data value to produce a first processed center data value that corresponds to the first center subpixel if the diagonal detector determines that the first red-blue data set does not include data for displaying any diagonal line.

The first processor may multiply the first center data value by 1 to produce the first first-type line center data value. The second processor may multiply the first center data value by 0 to produce the first second-type line center data value.

The first 3-by-3 array may further include a first neighbor subpixel located at a center of a first (i.e., leftmost or rightmost) column of the first 3-by-3 array or located at a center of a first (i.e., top or bottom) row of the first 3-by-3 array. The first 9 data values may further include a first neighbor data value that corresponds to the first neighbor subpixel. The first processor may multiply the first neighbor data value by 0 to produce a first first-type line neighbor data value that corresponds to the first neighbor subpixel if the first center subpixel and the first neighbor subpixel are in the first-type subpixel lines. The second processor may multiply the first neighbor data value by 1 to produce a first second-type line neighbor data value that corresponds to the first neighbor subpixel if the first center subpixel and the first neighbor subpixel are in the second-type subpixel lines.

The first 3-by-3 array may further include a first adjacent subpixel located at a center of a third (i.e., rightmost or leftmost) column of the first 3-by-3 array or located at a center of a third (i.e., bottom or top) row of the first 3-by-3 array. The first 9 data values may further include a first adjacent data value that corresponds to the first adjacent subpixel. At least one of the first processor and the second processor may multiply the first adjacent data value by 0 to produce a first first-type line adjacent data value that corresponds to the first adjacent subpixel.

At least one of the first processor and the second processor may multiply each of 7 data values of the first 9 data values other than the first center data value and the first neighbor data value by 0 to produce 7 processed data values that correspond to 7 subpixels of the first 3-by-3 subpixel array other than the first center subpixel and the first neighbor subpixel.

The data processing apparatus may include a third processor configured to process the first center data value and the first neighbor data to produce a first processed center data value and a first processed neighbor data value that correspond to the first center subpixel and the first neighbor subpixel, respectively, if the diagonal detector determines that the first red-blue data set does not include data for displaying any diagonal line.

The third processor may multiply the first center data value by 1 to produce the first processed center data value. The third processor may multiply the first neighbor data value by 0 to produce the first processed neighbor data value.

The data processing apparatus may output the first first-type line center data value or a value generated based on the first first-type line center data value for controlling the center subpixel if the first center subpixel is in the first-type subpixel lines or if the diagonal detector determines that the first red-blue data set is not for displaying any diagonal line. The data processing apparatus may output the second first-type line center data value or a value generated based on the first second-type line center data value for controlling the center subpixel if the first center subpixel is in the second-type subpixel lines and if the diagonal detector determines that the first red-blue data set is for displaying a diagonal line.

The data processing apparatus may include a data matcher configured to form the first red-blue data set based on a red-green-blue data set. The data matcher may further form a second red-blue data set based on the red-green-blue data set. The second red-blue data set may include second 9 data values that correspond to second 9 subpixels among the subpixels. The second 9 subpixels may form a second 3-by-3 array. The second 3-by-3 array may include a second center subpixel located at a center of the second 3-by-3 array. The second 3-by-3 array may further include a second neighbor subpixel located at a center of a first column of the second 3-by-3 array or located at a center of a first row of the second 3-by-3 array. The second 9 data values may include a second center data value and a second neighbor data value that correspond to the second center subpixel and the second neighbor subpixel, respectively. The second neighbor subpixel may be the first center subpixel. The second center subpixel may be the first adjacent subpixel.

The second neighbor data value may be equal to the first first-type line center data value or the first second-type line center data value. The first processor may multiply the first first-type line center data value by 0 to produce a second first-type line neighbor data value that corresponds to the second neighbor subpixel if the second center subpixel and the second neighbor subpixel are in the first-type subpixel lines. The second processor may multiply the first second-type line center data value by 1 to produce a second second-type line neighbor data value that corresponds to the second neighbor subpixel if the second center subpixel and the second neighbor subpixel are in the second-type subpixel lines.

An embodiment of the present invention may be related to a display device that may include a display unit that includes a plurality of subpixels disposed in a display area. The subpixels may include red subpixels, green subpixels, and blue subpixels arranged in first-type subpixels lines and second-type subpixel lines that are alternately disposed. The first-type subpixel lines may include a first first-type subpixel line. The second-type subpixel lines may include a first second-type subpixel line that immediately neighbors the first first-type subpixel line. The display device may further include a data processing apparatus configured to provide data values for controlling at least a portion of the subpixels to display a diagonal line at a diagonal line location. The diagonal line may substantially overlap or be substantially parallel to a diagonal of the display area. The display device may further include hardware for performing one or more tasks associated with at least one of the display unit and the data processing apparatus. The data values are configured for controlling the portion of the subpixels such that a first green subpixel arranged in the first first-type subpixel line and located at the diagonal line location is configured to emit light (i.e., is on) for display of the diagonal line, a first blue subpixel immediately neighboring the first green subpixel is configured to emit light (i.e., is on) for the display of the diagonal line, a first red subpixel immediately neighboring the first green subpixel is configured not to emit light (i.e., is off) for the display of the diagonal line, a second green subpixel arranged in the first second-type subpixel line and located at the diagonal line location is configured to emit light (i.e., is on) for the display of the diagonal line, a second blue subpixel immediately neighboring the second green subpixel is configured not to emit light (i.e., is off) for the display of the diagonal line, and a second red subpixel immediately neighboring the second green subpixel is configured to emit light (i.e., is on) for the display of the diagonal line.

The first blue subpixel and the first red subpixel may be arranged in the first first-type subpixel line. The first green subpixel may be disposed between the first blue subpixel and the first red subpixel. The second blue subpixel and the second red subpixel may be arranged in the first second-type subpixel line. The second green subpixel may be disposed between the second blue subpixel and the second red subpixel.

The first first-type subpixel line may include a blue-red subpixel line and a first green subpixel line. The first second-type subpixel line may include a red-blue subpixel line and a second green subpixel line. The first blue subpixel and the first red subpixel may be arranged in the blue-red subpixel line. The first green subpixel may arranged in the first green subpixel line and positioned between the first blue subpixel and the first red subpixel, The second blue subpixel and the second red subpixel may be arranged in the red-blue subpixel line. The second green subpixel may be arranged in the second green subpixel line and positioned between the second blue subpixel and the second red subpixel.

The data processing apparatus may include a diagonal detector configured to determine whether a red-blue data set includes data for displaying any diagonal line, the red-blue data set including 9 data values that correspond to 9 subpixels among the subpixels, the 9 subpixels forming a 3-by-3 array and including a portion of the red subpixel and a portion of the blue pixels, the 3-by-3 array including a center subpixel located at center of the 3-by-3 array, the 9 data values including a center data value that corresponds to the center subpixel. The data processing apparatus may further include a first processor configured to process the center data value using a first coefficient to produce a first-type line center data value that corresponds to the center subpixel if the center subpixel is in the first-type subpixel lines. The data processing apparatus may further include a second processor configured to process the center data value using a second coefficient different from the first coefficient to produce a second-type line center data value that corresponds to the center subpixel if the center subpixel is in the second-type subpixel lines. The data values include a data value generated based on at least one of the first-type line center data value and the second-type line center data value.

An embodiment of the present invention may be related to a method for controlling a display device to display a diagonal line at a diagonal line location. The display device may include a plurality of subpixels disposed in a display area. The subpixels may include red subpixels, green subpixels, and blue subpixels arranged in first-type subpixels lines and second-type subpixel lines that are alternately disposed. The first-type subpixel lines may include a first first-type subpixel line. The second-type subpixel lines may include a first second-type subpixel line that immediately neighbors the first first-type subpixel line. The method may be performed using hardware circuitry. The method may include the following steps: controlling a first green subpixel arranged in the first first-type subpixel line and located at the diagonal line location to emit light (i.e., to be on) for display of the diagonal line; controlling a first blue subpixel immediately neighboring the first green subpixel to emit light (i.e., to be on) for the display of the diagonal line; controlling a first red subpixel immediately neighboring the first green subpixel not to emit light (i.e., to be off) for the display of the diagonal line; controlling a second green subpixel arranged in the first second-type subpixel line and located at the diagonal line location to emit light for the display of the diagonal line; controlling a second blue subpixel immediately neighboring the second green subpixel not to emit light for the display of the diagonal line; and controlling a second red subpixel immediately neighboring the second green subpixel to emit light for the display of the diagonal line.

The first blue subpixel and the first red subpixel may be arranged in the first first-type subpixel line. The first green subpixel may be disposed between the first blue subpixel and the first red subpixel. The second blue subpixel and the second red subpixel may be arranged in the first second-type subpixel line. The second green subpixel may be disposed between the second blue subpixel and the second red subpixel.

The first first-type subpixel line may include a blue-red subpixel line and a first green subpixel line. The first second-type subpixel line may include a red-blue subpixel line and a second green subpixel line. The first blue subpixel and the first red subpixel may be arranged in the blue-red subpixel line. The first green subpixel may arranged in the first green subpixel line and positioned between the first blue subpixel and the first red subpixel, The second blue subpixel and the second red subpixel may be arranged in the red-blue subpixel line. The second green subpixel may be arranged in the second green subpixel line and positioned between the second blue subpixel and the second red subpixel.

The method may include the following steps: determining whether a red-blue data set includes data for displaying any diagonal line, the red-blue data set including 9 data values that correspond to 9 subpixels among the subpixels, the 9 subpixels forming a 3-by-3 array and including a portion of the red subpixel and a portion of the blue pixels, the 3-by-3 array including a center subpixel located at center of the 3-by-3 array, the 9 data values including a center data value that corresponds to the center subpixel; processing the center data value using a first coefficient to produce a first-type line center data value that corresponds to the center subpixel if the center subpixel is in the first-type subpixel lines; processing the center data value using a second coefficient different from the first coefficient to produce a second-type line center data value that corresponds to the center subpixel if the center subpixel is in the second-type subpixel lines; and processing at least one of the first-type line center data value and the second-type line center data value to generate a control data value for controlling at least one of the first blue subpixel and the first red subpixel.

The 3-by-3 array may further include a neighbor subpixel located at a center of a first column of the 3-by-3 array or located at a center of a first row of the 3-by-3 array. The first 9 data values may further include a neighbor data value that corresponds to the neighbor subpixel. The method may include processing the neighbor data value using the second coefficient to produce a first-type line neighbor data value that corresponds to the neighbor subpixel if the center subpixel and the neighbor subpixel are in the first-type subpixel lines. The method may include processing the neighbor data using the first coefficient to produce a second-type line neighbor data value that corresponds to the neighbor subpixel if the center subpixel and the neighbor subpixel are in the second-type subpixel lines.

An embodiment of the present invention may be related to a data processing apparatus that may include the following elements: a diagonal detector determining whether 3×3 RB image data including red image data and blue image data indicate a diagonal; an odd-numbered line rendering filter of which a scale coefficient corresponding to center data of the 3×3 RB image data is set to be 1; and an even-numbered line rendering filter of which a scale coefficient corresponding to data in a previous column to the center data of the 3×3 RB image data is set to be 1. In a case in which the 3×3 RB image data indicate the diagonal, if the center data of the 3×3 RB image data are data of an odd-numbered row line, a process of the rendering the 3×3 RB image data is performed through the odd-numbered line rendering filter, and if the center data of the 3×3 RB image data are data of an even-numbered row line, the process of the rendering the 3×3 RB image data is performed through the even-numbered line rendering filter.

The data processing apparatus may include a common rendering filter of which a scale coefficient corresponding to the center data of the 3×3 RB image data is set to be 1, and if the 3×3 RB image data do not indicate any diagonal, the process of rendering the 3×3 RB image data may be performed through the common rendering filter.

The data processing apparatus may further include an 8 color converter for converting a grayscale value of each of the red image data and the blue image data of which the rendering process is performed through the common rendering filter, the odd-numbered line rendering filter, and the even-numbered line rendering filter into any one of a maximum grayscale value and a minimum grayscale value.

The diagonal detector may include a plurality of pattern masks for recognizing the diagonal, and matches the 3×3 RB image data to the plurality of pattern masks to thereby determine whether the 3×3 RB image data indicate the diagonal.

The pattern mask may include 9 cells formed in a 3×3 matrix structure, and may include a structure in which two or more on-cells corresponding to a sub-pixel emitting light among the 9 cells are diagonally arranged.

The data processing apparatus may include a data matcher that configured to match (or map) RGB image data including red image data, green image data, and blue image data to a plurality of sub-pixels having a four-subpixel pixel layout structure to convert into RGBG image data. The data matcher may generate 3×3 RB image data by excluding the green image data from the RGBG image data.

An embodiment of the present invention may be related to a data processing apparatus that may include the following elements: a diagonal detector generating diagonal information instructing whether 3×3 RB image data including red image data and blue image data indicate a diagonal and line information instructing whether center data of the 3×3 RB image data pertains to an odd-numbered row line or an even-numbered row line; an odd-numbered line rendering filter of which a scale coefficient corresponding to the center data of the 1×3 RB image data including the red image data and the blue image data is set to be 1; an even-numbered line rendering filter of which a scale coefficient corresponding to data in a previous column to the center data of the 1×3 RB image data is set to be 1; and a selector for selecting one of the image data of which the rendering process is performed through the odd-numbered line rendering filter and the image data of which the rendering process is performed through the even-numbered line rendering filter according to the diagonal information and the line information.

The selector may select the image data of which the rendering process is performed through the odd-numbered line rendering filter if the line information indicates an odd-numbered line.

The selector may select the image data of which the rendering process is performed through the even-numbered line rendering filter if the line information indicates an even-numbered line and if the diagonal information indicates a diagonal.

The selector may select the image data of which the rendering process is performed through the odd-numbered line rendering filter if the line information indicates an even-numbered line and if the diagonal information instructs no diagonal.

The diagonal detector includes a plurality of pattern masks for recognizing the diagonal, and matches the 3×3 RB image data to the plurality of pattern masks to thereby determine whether the 3×3 RB image data indicate the diagonal.

The data processing apparatus may further include a data matcher that may match (or map) RGB image data including the red image data, green image data, and the blue image data to a plurality of sub-pixels having a four-subpixel pixel layout structure to convert into RGBG image data. The data matcher may generate 3×3 RB image data and 1×3 RB image data by excluding the green image data from the RGBG image data.

The data matcher may compare a grayscale value of each of the red image data and the blue image data included in the RGBG image with a threshold value to thereby convert the red image data and the blue image data included in the RGBG image into 0 or 1.

An embodiment of the present invention may be related to a display device that may include the following elements: a display unit including a plurality of pixels, wherein each of the plurality of pixels includes sub-pixels of red, green, blue, and green; and a data processing apparatus including an odd-numbered line rendering filter of which a scale coefficient corresponding to center data of 3×3 RB image data including red image data and blue image data is set to be 1 and an even-numbered line rendering filter of which a scale coefficient corresponding to data in a previous column to the center data of the 3×3 RB image data is set to be 1, and if the 3×3 RB image data indicates a diagonal, performing a process of rendering the 3×3 RB image data through the odd-numbered line rendering filter if the center data of the 3×3 RB image data are data of an odd-numbered row line and performing a process of rendering the 3×3 RB image data through the even-numbered line rendering filter if the center data of the 3×3 RB image data are data of an even-numbered row line.

The data processing apparatus may further include a common rendering filter of which the scale coefficient corresponding to the center data of the 3×3 RB image data is set to be 1, and in a case in which the 3×3 RB image data do not indicate the diagonal, the process of rendering the 3×3 RB image data may be performed through the common rendering filter.

The data processing apparatus may further include an 8 color converter converting a grayscale value of each of the red image data and the blue image data of which the rendering processes are performed through the common rendering filter, the odd-numbered line rendering filter, and the even-numbered line rendering filter into any one of a maximum grayscale value and a minimum grayscale value.

An embodiment of the present invention may be related to a display device that may include the following elements: a display unit including a plurality of pixels, wherein each of the plurality of pixels includes sub-pixels of red, green, blue, and green; and a data processing apparatus including an odd-numbered line rendering filter of which a scale coefficient corresponding to center data of 1×3 RB image data including red image data and blue image data is set to be 1 and an even-numbered line rendering filter of which a scale coefficient corresponding to data in a previous column to the center data of the 1×3 RB image data is set to be 1; and a selector selecting one of image data of which a rendering process is performed through the odd-numbered line rendering filter and image data of which the rendering process is performed through the even-numbered line rendering filter according to diagonal information instructing whether 3×3 RB image data including red image data and blue image data indicate a diagonal and line information instructing whether the center data of the 3×3 RB image data pertains to an odd-numbered row line or an even-numbered row line.

The selector may select the image data of which the rendering process is performed through the odd-numbered line rendering filter if the line information indicates an odd-numbered line, select the image data of which the rendering process is performed through the even-numbered line rendering filter if the line information indicates an even-numbered line and if the diagonal information indicates a diagonal, and select the image data of which the rendering process is performed through the odd-numbered line rendering filter if the line information indicates an even-numbered line and if the diagonal information indicates no diagonal.

An embodiment of the present invention may be related to a data processing method that may include the following steps: determining whether 3×3 RB image data including red image data and blue image data indicates a diagonal; performing a process of rendering the 3×3 RB image data through an odd-numbered line rendering filter of which a scale coefficient corresponding to center data of the 3×3 RB image data is set to be 1 if the 3×3 RB image data indicates a diagonal and if the center data of the 3×3 RB image data pertains to an odd-numbered row line; and performing a process of rendering the 3×3 RB image data through an even-numbered line rendering filter of which a scale coefficient corresponding to data in a previous column to the center data of the 3×3 RB image data is set to be 1 if the 3×3 RB image data indicates a diagonal and if the center data of the 3×3 RB image data pertains to an even-numbered row line.

The data processing method may further include performing a process of rendering the 3×3 RB image data through a common rendering filter of which the scale coefficient corresponding to the center data of the 3×3 RB image data is set to be 1 if the 3×3 RB image data indicates no diagonal.

According to embodiments of the present invention, image quality may be improved. For example, color distortion of a diagonal line displayed in the 8 color mode may be minimized.

BRIEF DESCRIPTION OF THE DRAWINGS

FIGS. 11A to 11S illustrate pattern masks of a data processing apparatus for recognizing image data for displaying a diagonal line according to an embodiment of the present invention.

DETAILED DESCRIPTION

Figure 1:
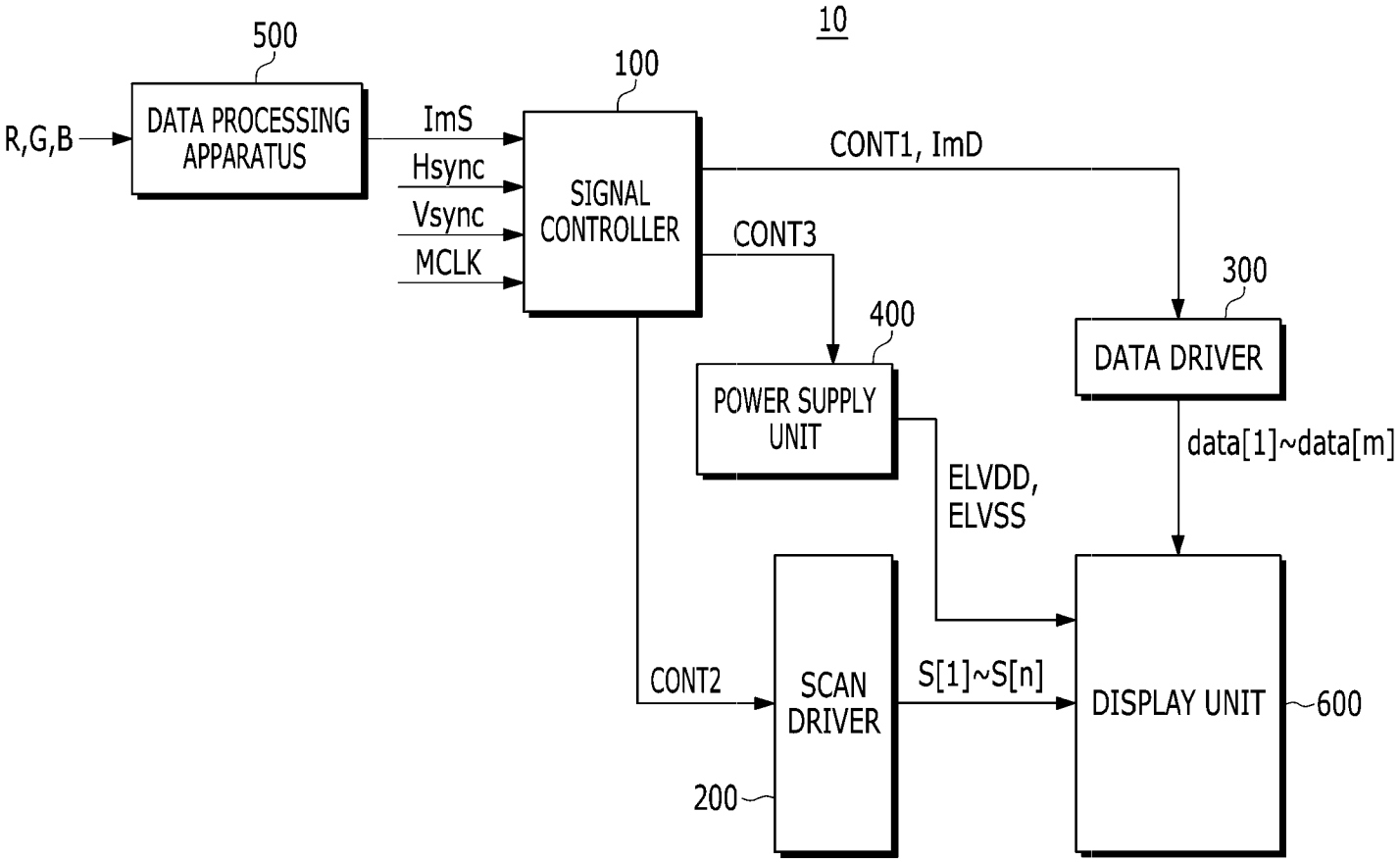
FIG. 1 is a block diagram illustrating a display device according to an embodiment of the present invention.

Hereinafter, some embodiments of the present invention will be described in detail with reference to the accompanying drawings so that those skilled in the art to which the present invention pertains may easily practice the present invention. The present invention may be modified in various ways and is not limited to the described embodiments.

Although the terms "first", "second", etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer, or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms "first", "second", etc. may also be used herein to differentiate different categories of elements. For conciseness, the terms "first", "second", etc. may represent "first-type (or first-category)", "second-type (or second-category)", etc., respectively.

In the description, the same reference numerals may be used to describe the same or similar elements. In the description and the claims that follow, if a first element is described to be "coupled" to a second element, the first element may be "directly coupled" to the second element or may be "electrically coupled" to the second element through a third element; the term "connect" may mean "electrically connect". In the description and the claims, unless explicitly described to the contrary, the word "comprise" and variations (such as "comprises" or "comprising") mean the inclusion of stated elements without requiring exclusion of other elements.

In the drawings, subpixels that emit lights are illustrated with dotted patterns, and subpixels that do not emit lights are illustrated without dotted patterns.

Various embodiments are described herein below, including methods and techniques. Embodiments of the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

FIG. 1 is a block diagram illustrating a display device 10 according to an embodiment of the present invention.

Referring to FIG. 1, the display device 10 includes a signal controller 100, a scan driver 200, a data driver 300, a power supply unit 400, a data processing apparatus 500, and a display unit 600.

The display unit 600 has a display area that includes a plurality of pixels. Each pixel of the plurality of pixels may have a four-subpixel pixel structure. That is, each pixel of the plurality of pixels may include 4 subpixels, for example, an R (red) subpixel, a first G (green) subpixel, a B (blue) subpixel, and a second G (green) pixel. The display unit 600 has scan lines that extend in a row direction and are substantially parallel to each other, data lines that extend in a column direction and are substantially parallel to each other, and power lines that are connected to the subpixels. The subpixels are arranged in a matrix form and are respectively disposed at intersections of the scan lines and the data lines.

Since the display unit 600 has the four-subpixel pixel structure, the data processing apparatus 500 may process RGB image data (R,G,B) input from an external device into RGBG subpixel data ImS. The data processing apparatus 500 may render the RGB image data (R,G,B) into the RGBG subpixel data ImS according to an 8 color mode. The RGBG subpixel data ImS may be input to the signal controller 100.

The signal controller 100 may receive the RGBG subpixel data ImS input from the data processing apparatus 500 and may receive a synchronizing signal provided by the external device. The RGBG subpixel data ImS may contain luminance information for subpixels. The luminance may have a gray-scale of a predetermined number, for example, $1024=2^{10}$, $256=2^{8}$, or $64=2^{6}$. In an embodiment, the RGB image data (R,G,B) may be rendered into the RGBG subpixel data ImS according to the 8 color mode, and the RGBG subpixel data ImS may contain on-off information for the subpixels. The synchronization signal may include a horizontal synchronization signal Hsync, a vertical synchronization signal Vsync, and a main clock signal MCLK.

The signal controller 100 may generate driving control signals CONT1, CONT2, and CONT3 and image data ImD according to the RGBG subpixel data ImS, the horizontal synchronization signal Hsync, the vertical synchronization signal Vsync, and the main clock signal MCLK.

The signal controller 100 may divide the RGBG subpixel data ImS based on a frame unit according to the vertical synchronization signal Vsync and divide the RGBG subpixel data ImS based on a scan line unit according to the horizontal synchronization signal Hsync to generate the image data ImD. The signal controller 100 may provide the image data ImD and the first driving control signal CONT1 to the data driver 300.

The scan driver 200 is connected to the scan lines. The scan driver 200 may generate a plurality of scan signals S[1]-S[n] according to the second driving control signal CONT2. The scan driver 200 may sequentially apply the scan signals S[1]-S[n], which may be gate-on voltages, to the scan lines.

The data driver 300 is connected to the data lines. The data driver 300 may process (e.g., sample and/or hold) the image data ImD input according to the first driving control signal CONT1 to generate a plurality of data signals data[1]-data[m]. The data signals data[1]-data[m] may have a predetermined voltage range. The data driver 300 may provide the data signals data[1]-data[m] to the data lines according to the scan signals S[1]-S[n].

The power supply unit 400 may determine a level of a first power source voltage ELVDD and a level of a second power source voltage ELVSS according to the third driving control signal CONT3 to supply the power source voltages ELVDD and ELVSS to the power lines connected to the pixels. The first power source voltage ELVDD and the second power source voltage ELVSS may provide driving currents of the pixels.

Figure 2:
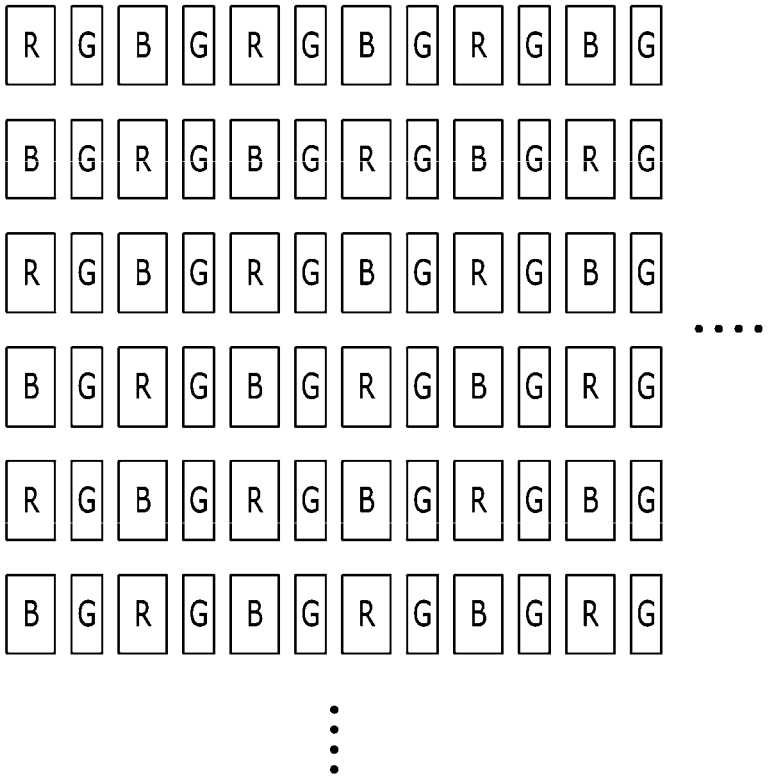
FIG. 2 illustrates a four-subpixel pixel layout structure of a display device according to an embodiment of the present invention.

FIG. 2 illustrates a four-subpixel pixel layout structure of the display unit 600 according to an embodiment of the present invention.

Referring to FIG. 2, each of a red subpixel, a first green subpixel, a blue subpixel, and a second green subpixel in a pixel of the display unit 600 may have a quadrangular shape in a plan view of the display unit 600. Typically, the human eye is more sensitive to green than to each of red and blue. Therefore, in the display unit 600, a green subpixel may be configured to be smaller than each of a red subpixel and a blue subpixel and may be disposed between the red subpixel and the blue subpixel.

Subpixel sets each including a red subpixel (R), a first green subpixel (G), a blue subpixel (B), and a second green subpixel (G) may be consecutively arranged in a row direction. Subpixel sets each including a red subpixel, a first green subpixel, a blue subpixel, and a second green subpixel sequentially arranged may be consecutively arranged in each odd-numbered row of the subpixels. Subpixel sets each including a blue subpixel, a first green subpixel, a red subpixel, and a second green subpixel sequentially arranged may be consecutively arranged in each even-numbered row of the subpixels. That is, the pattern "RGBG" may be repeated in each odd-numbered row of the subpixels, and the pattern "BGRG" may be repeated in each even-numbered row of the subpixels. Red subpixels and blue subpixels may be alternately arranged in a column of the subpixels, and green subpixels may be consecutively arranged in an immediately neighboring column of the subpixels. For example, red subpixels and blue subpixels may be alternately arranged in a first column of the subpixels, and green subpixels may be consecutively arranged a second column of the subpixels.

Figure 3:
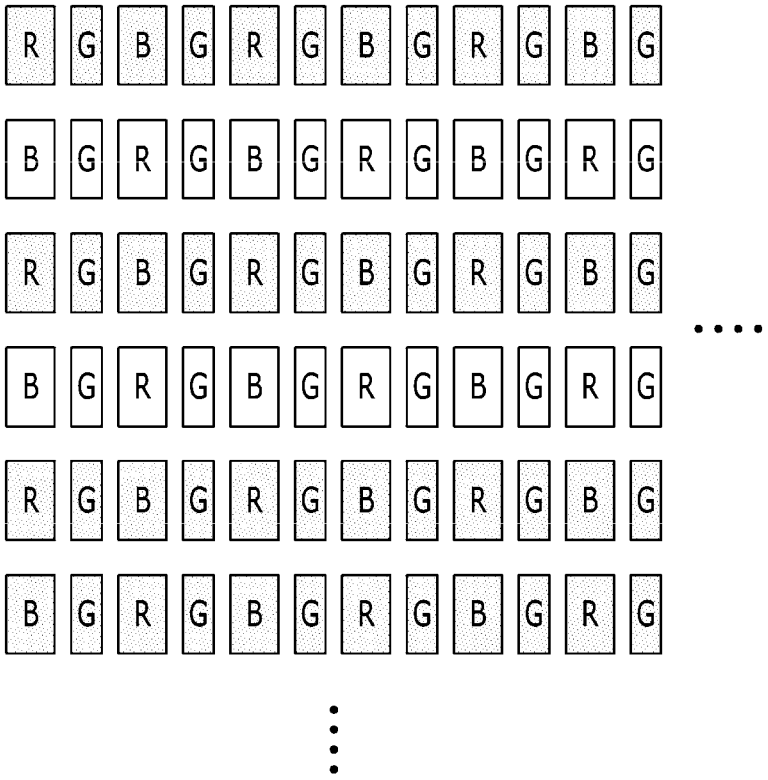
FIG. 3 illustrates that the four-subpixel pixel layout structure illustrated in FIG. 2 is configured to display a horizontal line according to an embodiment of the present invention.

In the four-subpixel pixel layout structure of the display unit 600, shapes, sizes, arrangements, etc. of the red subpixels, the green subpixels, and the blue subpixels may be varied according various embodiments. FIG. 3 illustrates that the four-subpixel pixel layout structure illustrated in FIG. 2 is configured to display a horizontal line according to an embodiment of the present invention.

Referring to FIG. 3, subpixels in a subpixel row that has consecutive "RGBG" patterns may emit light. In an embodiment, all the subpixels in the subpixel row may emit light. As a result, this subpixel row may display a white horizontal line without substantial color distortion. In this subpixel row, if only the red subpixels, only the green subpixels, or only the blue subpixels emit light, then the subpixel row may display a red horizontal line, a green horizontal line, or a blue horizontal line without substantial color distortion. In general, the display unit 600 may display a horizontal line without substantial color distortion.

Figure 4:
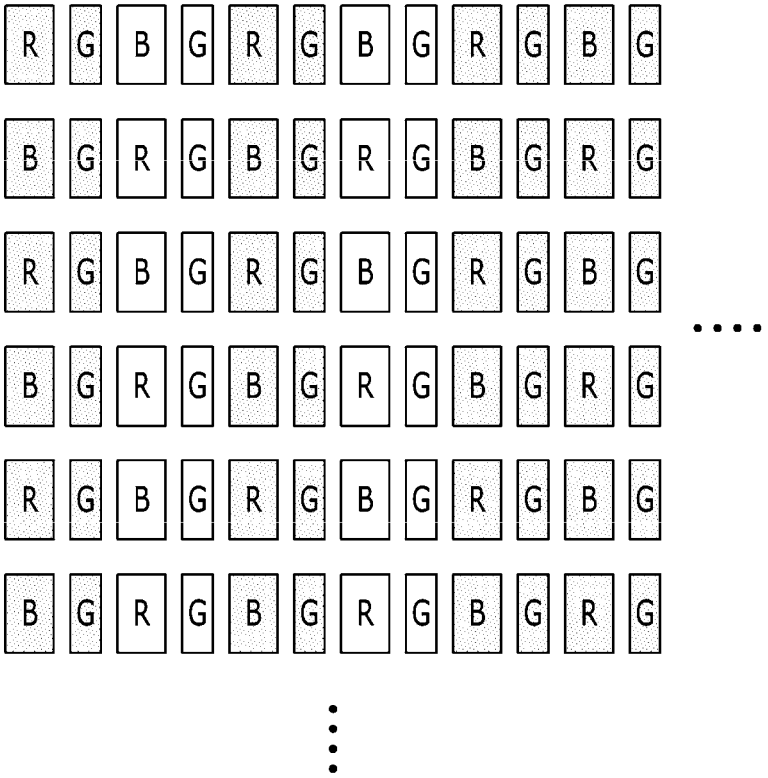
FIG. 4 illustrates that the four-subpixel pixel layout structure illustrated in FIG. 2 is configured to display a vertical line according to an embodiment of the present invention.

FIG. 4 illustrates that the four-subpixel pixel layout structure illustrated in FIG. 2 is configured to display a vertical line according to an embodiment of the present invention.

Referring to FIG. 4, alternately arranged red subpixels and blue subpixels in a first subpixel column may emit light, and consecutively arranged green subpixels in an immediately neighboring second subpixel column may emit light. In an embodiment, all the red subpixels and all the blue subpixels in the first subpixel column may emit light, and all the green subpixels in the second subpixel column may emit light. As a result, these two immediately neighboring subpixel columns may display a white vertical line without substantial color distortion. In these two subpixel columns, if only the red subpixels, only the green subpixels, or only the blue subpixels emit light, then the two subpixel columns may display a red vertical line, a green vertical line, or a blue vertical line without substantial color distortion. In general, the display unit 600 may display a vertical line without substantial color distortion.

Figure 5:
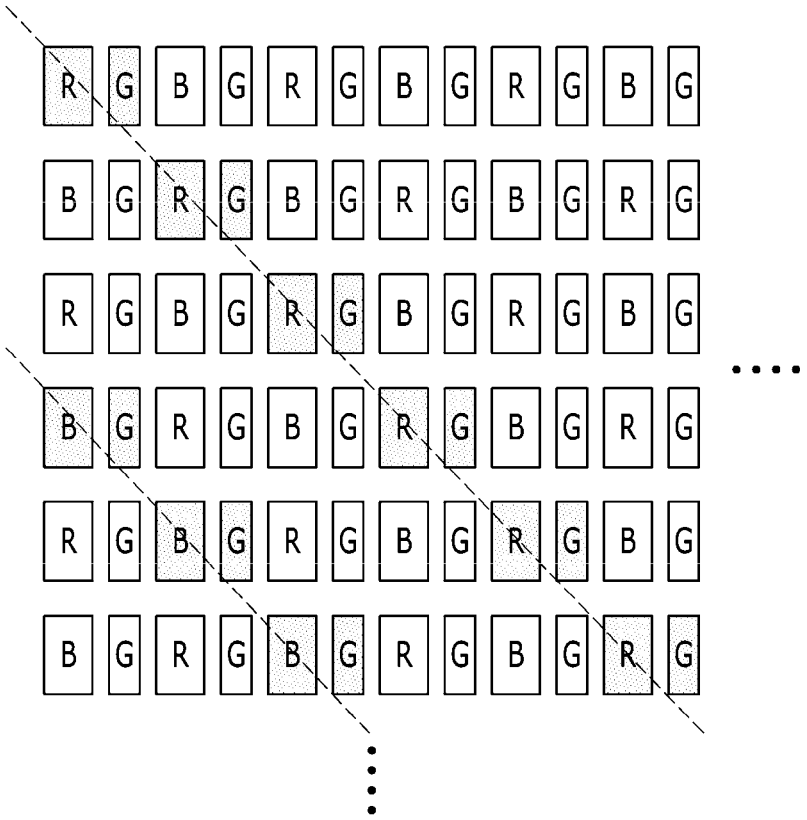
FIG. 5 illustrates that the four-subpixel pixel layout structure illustrated in FIG. 2 is configured to display a diagonal line according to an embodiment of the present invention.

FIG. 5 illustrates that the four-subpixel pixel layout structure illustrated in FIG. 2 is configured to display a diagonal line according to an embodiment. The diagonal line may be a diagonal that connects two corners of a display area of the display unit 600 or a slanting line that is parallel to the diagonal.

Referring to FIG. 5, a plurality of red subpixels and a plurality of green subpixels arranged along a diagonal may emit light to display a substantially yellow diagonal line. Additionally or alternatively, a plurality of blue subpixels and a plurality of green subpixels arranged along a diagonal may emit light to display a substantially cyan diagonal line If a white diagonal line is desired, the display device 10 may perform a rendering process (e.g., using the data processing apparatus 500) for displaying a substantially white diagonal line without substantial color distortion.

Figure 6:
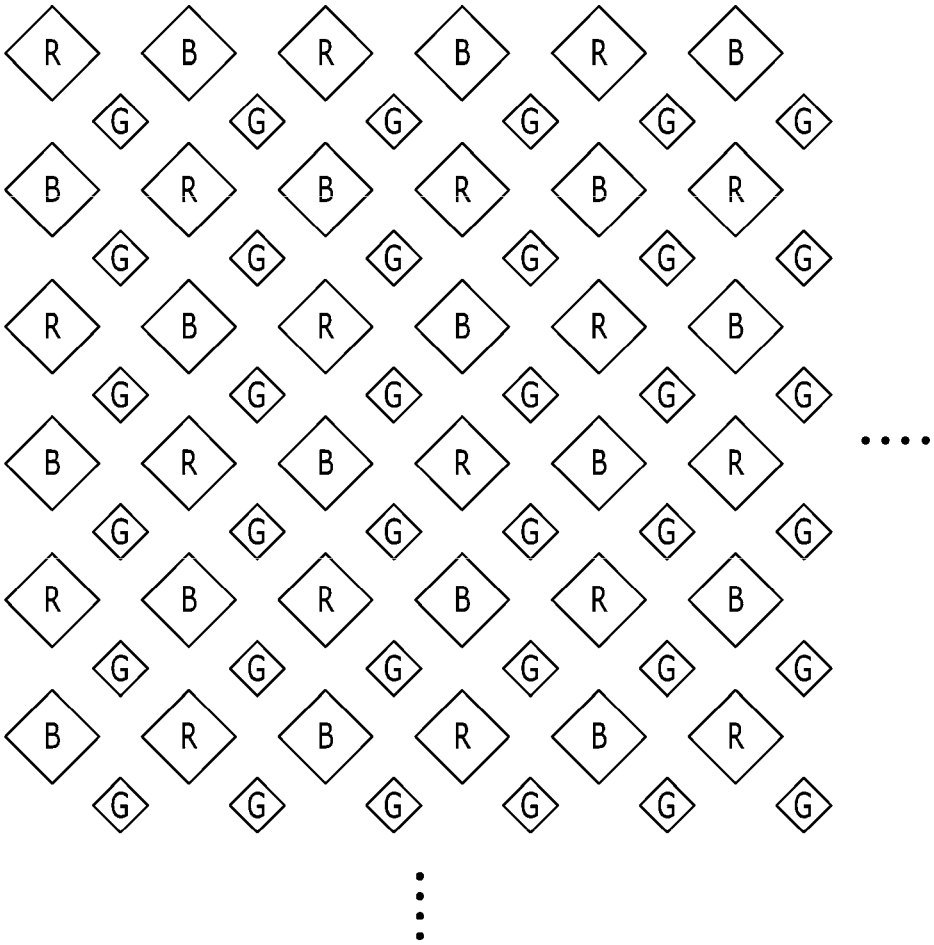
FIG. 6 illustrates a four-subpixel pixel layout structure of a display device according to an embodiment of the present invention.

FIG. 6 illustrates a four-subpixel pixel layout structure of the display unit 600 according to an embodiment of the present invention.

Referring to FIG. 6, each of a red subpixel, a first green subpixel, a blue subpixel, and a second green subpixel in a pixel of the display unit 600 may have a rhombus shape in a plan view of the display unit 600. Typically, the human eye is more sensitive to green than to each of red and blue. Therefore, a green subpixel may be configured to be smaller each of a red subpixel and a blue subpixel, and the green subpixel may be substantially surrounded by neighboring red pixels and blue pixels.

Red subpixels and blue subpixel may be alternately arranged in a row direction and in a column direction. Green subpixels may be arranged in the row direction and in the column direction and may be disposed between neighboring red subpixels and between neighboring blue subpixels. A green subpixel of a first pixel may be disposed between the red subpixel of the first pixel and the red subpixel of a second pixel and may be disposed between the blue subpixel of the first pixel and the blue subpixel of a third pixel. Each of the second pixel and the third pixel may immediately neighbor the first pixel.

In the four-subpixel pixel layout structure of the display unit 600, shapes, sizes, arrangements, etc. of the red subpixels, the green subpixels, and the blue subpixels may be varied according to various embodiments.

Figure 7:
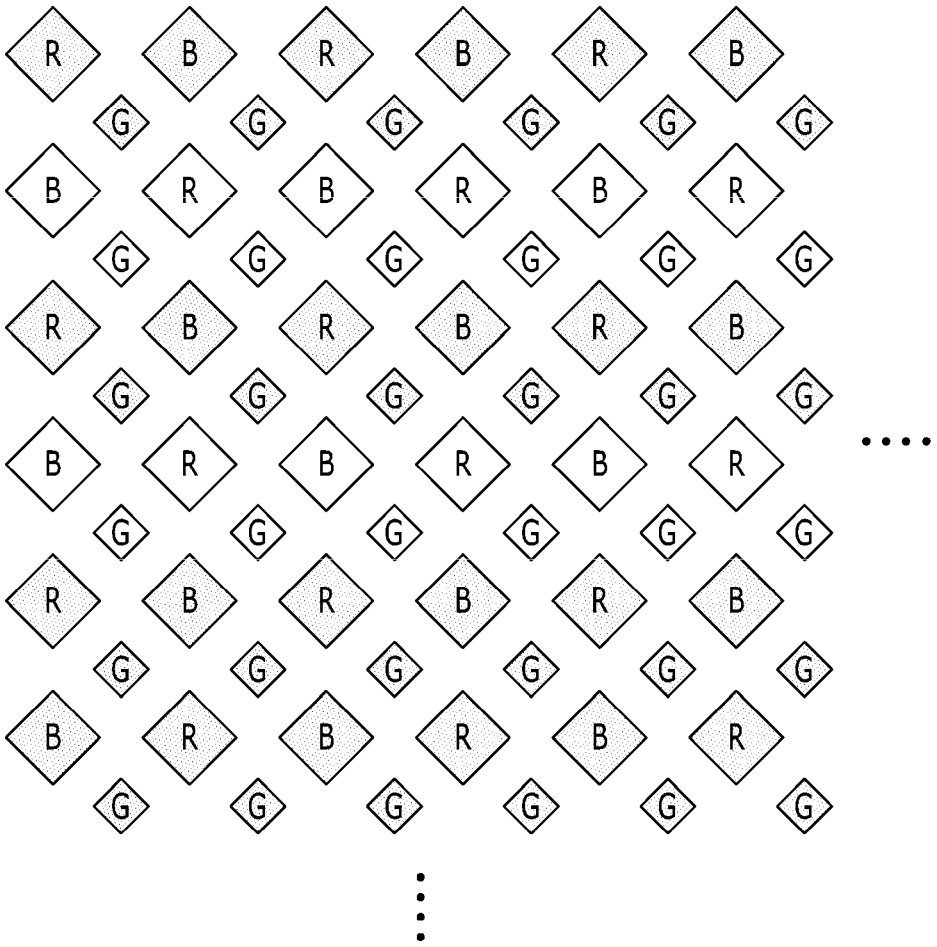
FIG. 7 illustrates that the four-subpixel pixel layout structure illustrated in FIG. 6 is configured to display a horizontal line according to an embodiment of the present invention.

FIG. 7 illustrates that the four-subpixel pixel layout structure illustrated in FIG. 6 is configured to display a horizontal line according to an embodiment of the present invention.

Referring to FIG. 7, red subpixels and blue subpixels in a first subpixel row may emit light, and green subpixels in an immediately neighboring second subpixel row may emit light. In an embodiment, all the red subpixels and all the blue subpixels in the first subpixel row may emit light, and all the green subpixels in the second subpixel row may emit light. As a result, these two immediately neighboring subpixel rows may display a white horizontal line without substantial color distortion. In these two subpixel rows, if only the red subpixels, only the green subpixels, or only the blue subpixels emit light, then the two subpixel row may display a red horizontal line, a green horizontal line, or a blue horizontal line without substantial color distortion. In general, the display unit 600 may display a horizontal line without substantial color distortion.

Figure 8:
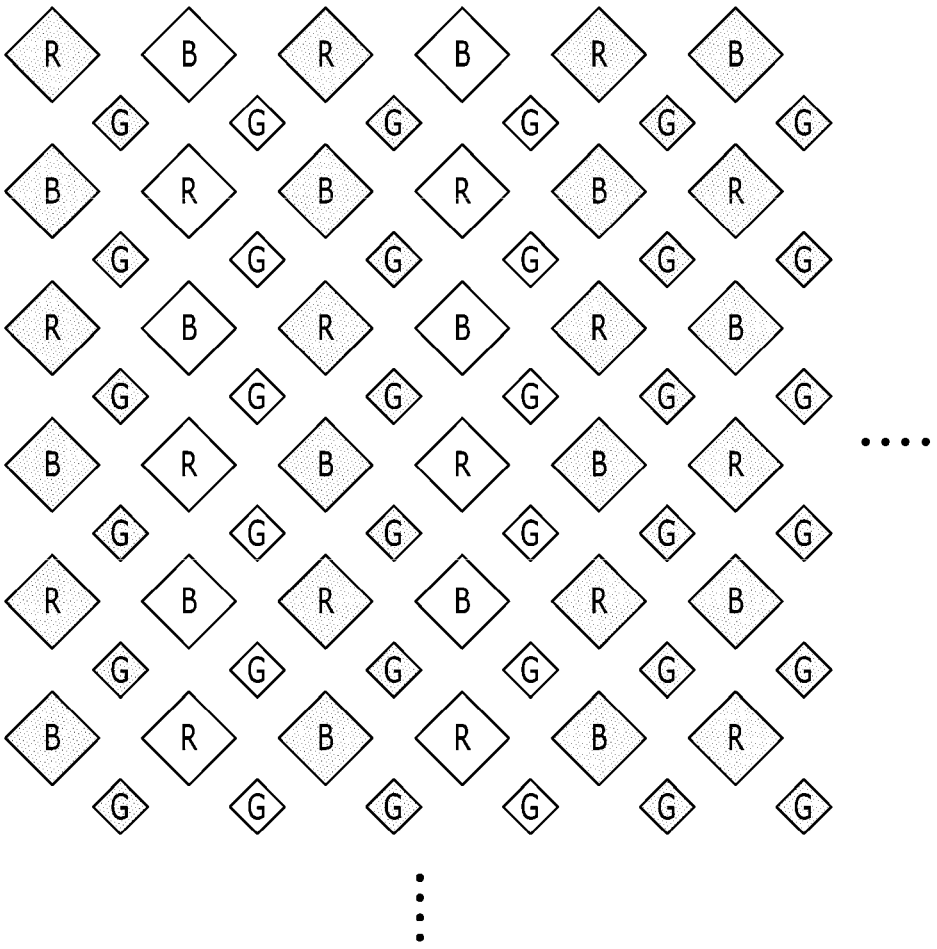
FIG. 8 illustrates that the -subpixel pixel layout structure illustrated in FIG. 6 is configured to display a vertical line according to an embodiment of the present invention.

FIG. 8 illustrates that the four-subpixel pixel layout structure illustrated in FIG. 6 is configured to display a vertical line according to an embodiment of the present invention.

Referring to FIG. 8, red subpixels and blue subpixels in a first subpixel column may emit light, and green subpixels in an immediately neighboring second subpixel column may emit light. In an embodiment, all the red subpixels and all the blue subpixels in the first subpixel column may emit light, and all the green subpixels in the second subpixel column may emit light. As a result, these two immediately neighboring subpixel columns may display a white vertical line without substantial color distortion. In these two subpixel columns, if only the red subpixels, only the green subpixels, or only the blue subpixels emit light, then the two subpixel column may display a red vertical line, a green vertical line, or a blue vertical line without substantial color distortion. In general, the display unit 600 may display a vertical line without substantial color distortion.

Figure 9:
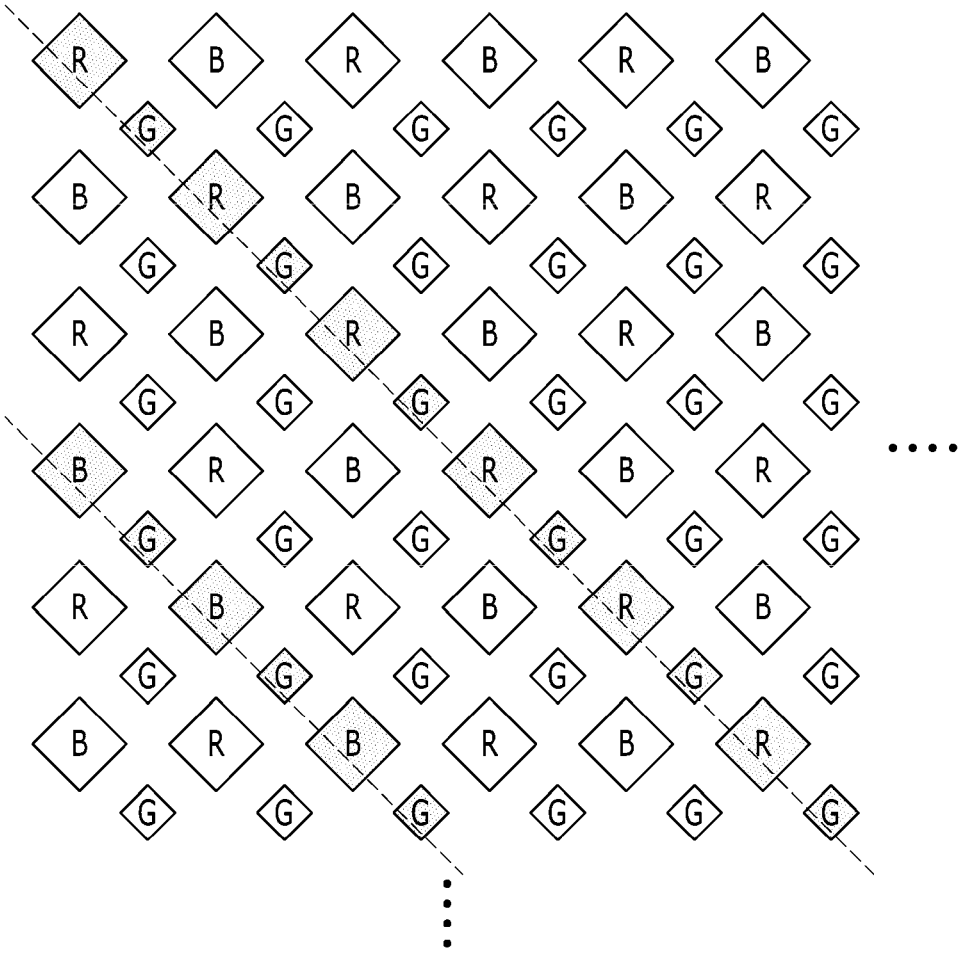
FIG. 9 illustrates that the four-subpixel pixel layout structure illustrated in FIG. 6 is configured to display a diagonal line according to an embodiment of the present invention.

FIG. 9 illustrates that the four-subpixel pixel layout structure illustrated in FIG. 6 is configured to display a diagonal line according to an embodiment of the present invention.

Referring to FIG. 9, a plurality of red subpixels and a plurality of green subpixels arranged along a diagonal may emit light to display a substantially yellow diagonal line. Additionally or alternatively, a plurality of blue subpixels and a plurality of green subpixels arranged along a diagonal may emit light to display a substantially cyan diagonal line.

If a white diagonal line is desired, the display device 10 may perform a rendering process (e.g., using the data processing apparatus 500) for displaying a substantially white diagonal line without substantial color distortion.

Figure 10:
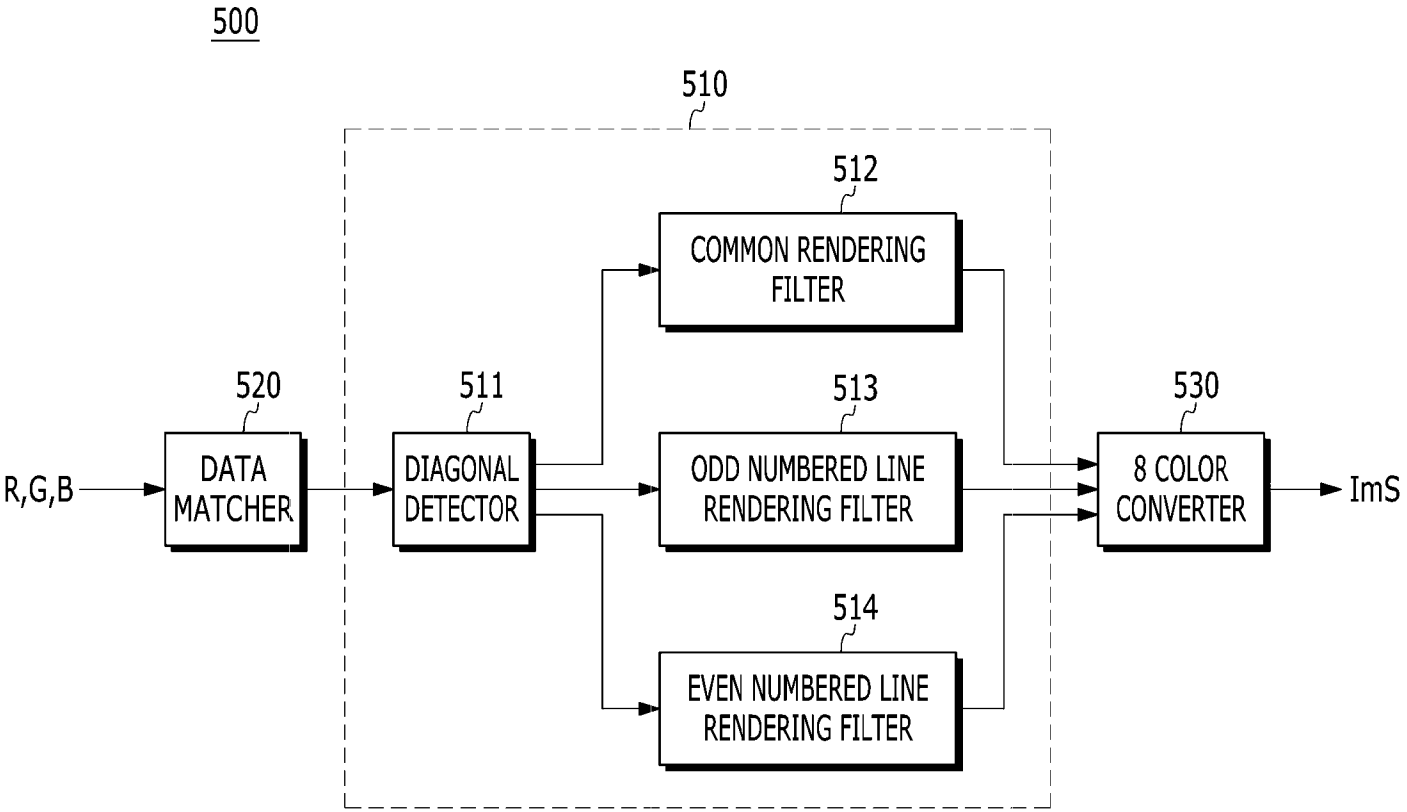
FIG. 10 is a block diagram illustrating a data processing apparatus according to an embodiment of the present invention.

FIG. 10 is a block diagram illustrating the data processing apparatus 500 according to an embodiment of the present invention.

Referring to FIG. 10, the data processing apparatus 500 includes a rendering unit 510 (e.g., an 8 color rendering unit 510), a data matcher 520, and a converter 530 (e.g., an 8 color converter 530).

The data matcher 520 may receive RGB image data (R,G,B) and may match (and/or map) the RGB image data (R,G,B) to subpixels of a four-subpixel pixel layout structure of the display unit 600. The RGB image data (R,G,B) may include red image data, green image data, and blue image data. The RGB image data corresponding to 6 subpixels (i.e., a first red subpixel, a first green subpixel, a first blue subpixel, a second red subpixel, a second green subpixel, and a second blue pixel) may be converted into RGBG image data corresponding to 4 subpixels (i.e., a red subpixel, a first green subpixel, a blue subpixel, and a second green subpixel). The RGBG image data include red image data, first green image data, blue image data, and second green image data.

The data matcher 520 may extract red image data and blue image data from the RGBG image data to generate 3×3 matrix RB image data (or 3×3 RB image data, for conciseness) that corresponds to a 3-subpixel-by-3-subpixel matrix unit (or 3×3 unit, for conciseness) of the display unit 600. The RB image data may exclude green image data of the RGBG image data. Each subpixel of the 3-subpixel-by-3-subpixel matrix unit may be a red subpixel or a blue subpixel. The RB image data may be extracted according to a predetermined order corresponding to red subpixels and blue subpixels of the display unit 600. The data matcher 520 may provide the RB image data to a diagonal detector 511

The rendering unit 510 may include the diagonal detector 511, a common rendering filter 512 (or common processor 512), an odd-numbered line rendering filter 513 (or odd-numbered line processor 513), and an even-numbered line rendering filter 514 (or even-numbered line processor 514).

The diagonal detector 511 may include a plurality of pattern masks (i.e., pattern template and/or pattern criteria) for recognizing image data for displaying a diagonal line. The diagonal detector 511 may match and/or compare the RB image data with the pattern masks (or pattern criteria) to determine whether the RB image data represents data for displaying a diagonal line.

FIGS. 11A to 11S illustrate the pattern masks of the diagonal detector 511 for recognizing image data for displaying a white diagonal line according to an embodiment of the present invention.

Referring to FIGS. 11A to 11S, each pattern mask may include 9 cells that are formed in a 3×3 matrix. In FIGS. 11A to 11S, on cells 1 (illustrated with dotted patterns) may correspond to subpixels that are supposed to emit light according to the RB image data, and cells 0 (illustrated without dotted patterns) may correspond to subpixels that are not supposed to emit light according to the RB image data.

Each pattern mask may have a pattern in which at least two immediately neighboring on cells 1 are arranged on (and/or along) a diagonal line of the pattern mask, wherein the diagonal line may be a diagonal that connects two corner cells of the pattern mask or a slanting line that is parallel to the diagonal. The pattern masks may exclude patterns in which any cell row or any cell column includes at least two on cells 1 that abut (i.e., immediately neighbor) each other. The pattern masks may exclude patterns in which two on cells 1 are arranged on (and/or aligned alone) any diagonal and are separated by an off cell 0 (i.e., do not immediately neighbor each other).

In an embodiment, the pattern masks may be configured for detecting image data for displaying a black diagonal line on a white background, and each pattern mask may have a pattern in which at least two immediately neighboring off cells 0 are arranged on (and/or along) a diagonal line of the pattern mask, in which no cell row or cell column includes at least two off cells 0 that abut (i.e., immediately neighbor) each other, and/or in which no off cells 0 are arranged on (and/or along) a diagonal and separated by an on cell 1. Referring to FIG. 10, if the 3×3 RB image data does not match the pattern of any of the pattern masks illustrated in FIGS. 11A to 11S, that is, if the 3×3 RB image data is not for displaying a diagonal line, the diagonal detector 511 may provide the 3×3 RB image data to the common rendering filter 512.

If the 3×3 RB image data matches at least one of the pattern masks, that is, if the 3×3 RB image data is for displaying a diagonal line, the diagonal detector 511 may determine whether the center data of the 3×3 RB image data is data for controlling a subpixel in an odd-numbered subpixel line (e.g., an odd-numbered subpixel row) or data for controlling a subpixel in an even-numbered subpixel line (e.g., an even-numbered subpixel row). The center data of the 3×3 RB image data is the data positioned at the intersection of the second row and the second column of the 3×3 RB image data and is for controlling the center subpixel positioned at the intersection of the second row and the second column of the corresponding 3×3 unit of the display unit 600. If the center data of the 3×3 RB image data is data for controlling a subpixel in an odd-numbered subpixel line (e.g., row), the diagonal detector 511 may provide the 3×3 RB image data to an odd-numbered line rendering filter 513. If the center data of the 3×3 RB image data is data for controlling a subpixel in an even-numbered subpixel line (e.g., row), the diagonal detector 511 may provide the 3×3 RB image data to the even-numbered line rendering filter 514.

The common rendering filter 512 may perform a rendering process by applying scale coefficients to the 3×3 RB image data. In an embodiment, the scale coefficient corresponding to the center data of the 3×3 RB image data may be set to 1, and the scale coefficient corresponding to the remaining data of the 3×3 RB image data may be set to 0. The center data of the 3×3 RB image data may be output by the common rendering filter 512.

The odd-numbered line rendering filter 513 may perform a rendering process by applying scale coefficients to the 3×3 RB image data. In an embodiment, the scale coefficient corresponding to the center data of the 3×3 RB image data may be set to 1, and the scale coefficient corresponding to the remaining data of the 3×3 RB image data may be set to 0. The center data of the 3×3 RB image data may be output by the odd-numbered line rendering filter 513.

The odd-numbered line rendering filter 513 and the common rendering filter 512 may have the same configuration. In an embodiment, the common rendering filter 512 may be omitted. If the 3×3 RB image data is not for displaying a diagonal line, the rendering process may be performed by the odd-numbered line rendering filter 513.

The even-numbered line rendering filter 514 may perform a rendering process by applying scale coefficients to the 3×3 RB image data. In an embodiment, the scale coefficient corresponding to the first-column-center data of the 3×3 RB image data, i.e., data in a column preceding (e.g., to the left of) the center data of the 3×3 RB image data, may be set to 1, and the scale coefficient corresponding to the remaining data of the 3×3 RB image data may be set to 0. That is, the scale coefficient 1 is applied to the data at the intersection of the second row and the first column of the 3×3 RB image data, and the scale coefficient 0 is applied to the remaining data of the 3×3 RB image data. The first-column-center data of the 3×3 RB image data may be output by the even-numbered line rendering filter 514.

The outputs of the common rendering filter 512, the odd-numbered line rendering filter 513, and the even-numbered line rendering filter 514, which may include red image data for red subpixels and/or blue image data for blue subpixels, may be provided to the 8 color converter 530. The green image data corresponding to green subpixels of the display unit 600 may be provided from the data matcher 520 to the 8 color converter 530 without undergoing a rendering process.

The 8 color converter 530 may convert the grayscale value of each of red image data for a red subpixel, first green image data for a first green subpixel, blue image data for a blue subpixel, and second green image data for a second green subpixel into one of a maximum grayscale value and a minimum grayscale value. The 8 color converter 530 may compare the grayscale value of each of the red image data, the first green image data, the blue image data, and the second green image data with a threshold value. The 8 color converter 530 may convert the grayscale value of the image data that is equal to or larger than the threshold value into the maximum grayscale value. The 8 color converter 530 may convert the grayscale value of the image data that is smaller than the threshold value into the minimum grayscale value.

In an embodiment, each of the red image data, the first green image data, the blue image data, and the second green image data may be represented by a grayscale of 0-255, for 8 bit pixels. The 8 color converter 530 may determine whether a value of a most significant bit (MSB) for each of the red image data, the first green image data, the blue image data, and the second green image data is 1. Image data of which the MSB is 1 (that is, image data with grayscale value greater than or equal to "10000000") may be converted into image data "11111111", the maximum grayscale value. Image data of which the MSB is 0 (that is, image data with grayscale value less than or equal to "01111111") may be converted into the image data "00000000", the minimum grayscale value.

The 8 color converter 530 may provide the maximum grayscale value(s) and/or minimum grayscale value(s) that represent the red image data, the first green image data, the blue image data, and the second green image as the RGBG subpixel data ImS.

The rendering processes performed through the odd-numbered line rendering filter 513 and the even-numbered line rendering filter 514 are further described with reference to FIGS. 12 to 16.

Figure 12:
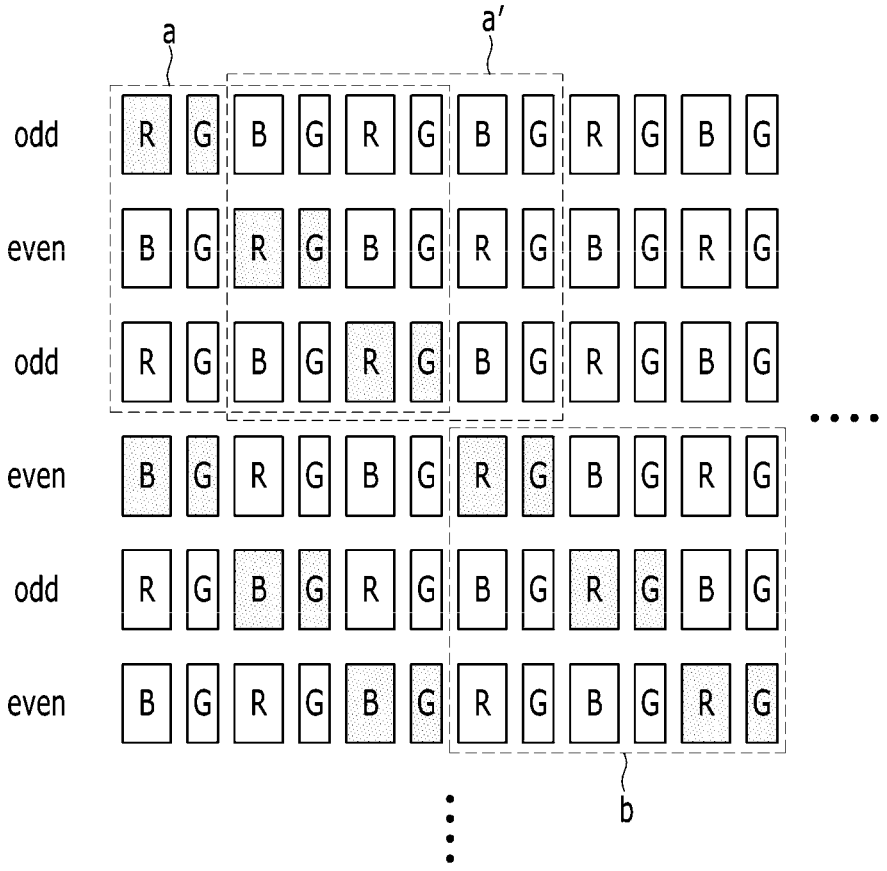
FIG. 12 illustrates selections of data portions in RGBG image data that is for displaying a diagonal line in a four-subpixel layout structure of a display device according to an embodiment of the present invention.
Figure 13:
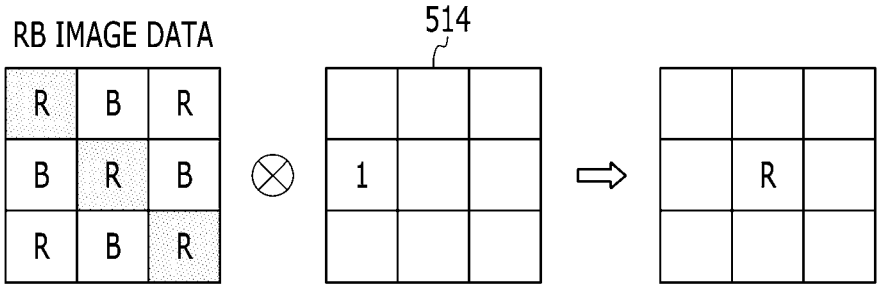
FIG. 13 illustrates a rendering process performed on a data portion illustrated in FIG. 12 according to an embodiment of the present invention.
Figure 14:
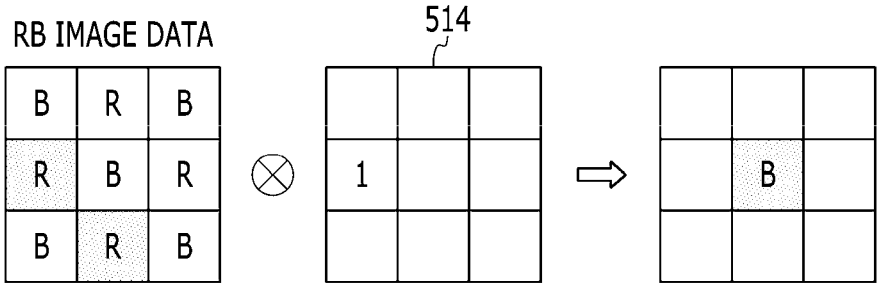
FIG. 14 illustrates a rendering process performed on a data portion illustrated in FIG. 12 according to an embodiment of the present invention.
Figure 15:
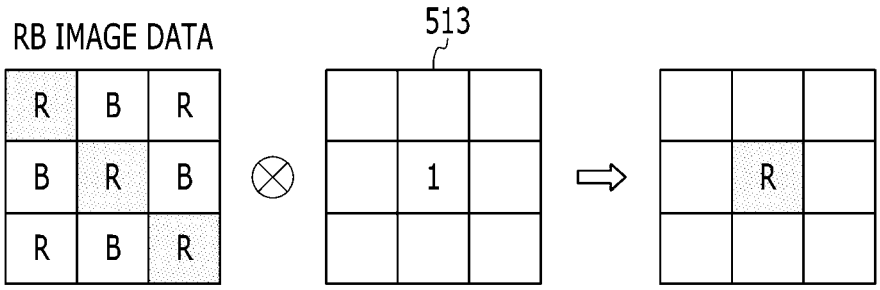
FIG. 15 illustrates a rendering process performed on a data portion illustrated in FIG. 12 according to an embodiment of the present invention.
Figure 16:
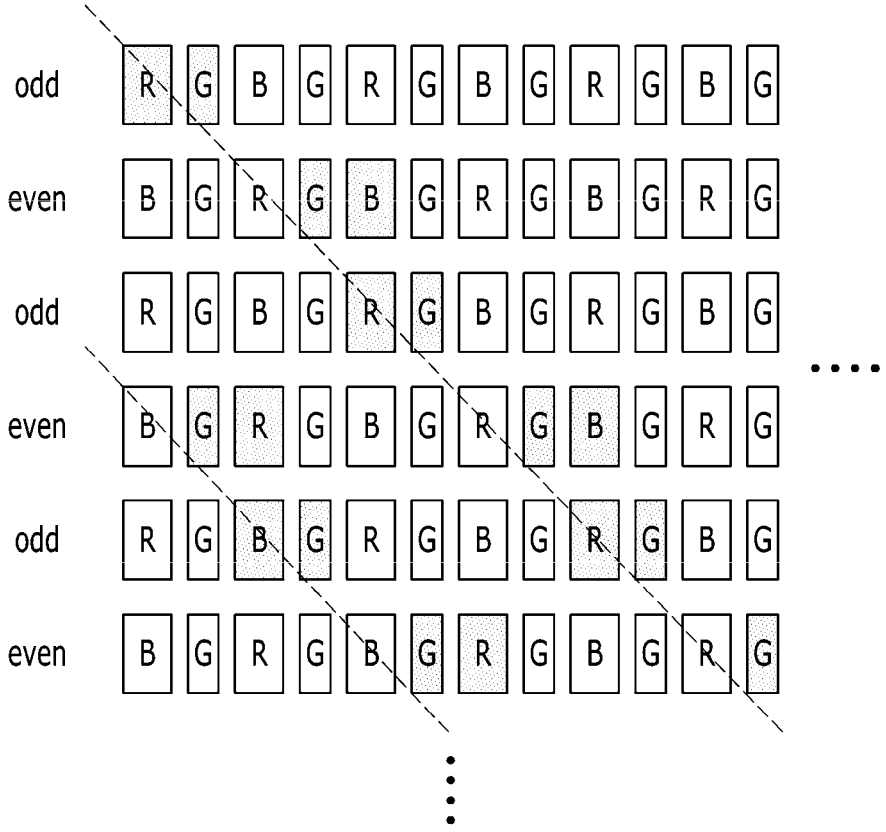
FIG. 16 illustrates resulted RGBG image data after a rendering process has been performed on the RGBG image data illustrated in FIG. 12 according to an embodiment of the present invention.

FIG. 12 illustrates selections of data portions in RGBG image data that is for displaying a diagonal line in line in a four-subpixel layout structure of a display device according to an embodiment of the present invention. FIG. 13 illustrates a rendering process performed on a data portion illustrated in FIG. 12 according to an embodiment of the present invention. FIG. 14 illustrates a rendering process performed on a data portion illustrated in FIG. 12 according to an embodiment of the present invention. FIG. 15 illustrates a rendering process performed on a data portion illustrated in FIG. 12 according to an embodiment of the present invention. FIG. 16 illustrates a result of a rendering process performed using data illustrated in FIG. 12 according to an embodiment of the present invention.

The data matcher 520 may receive RGBG image data (illustrated in FIG. 12) for displaying a diagonal line. The blocks illustrated with dotted patterns may represent turn-on data for controlling corresponding subpixels to turn on and/or to emit light; the blocks illustrated without dotted patterns may represent turn-off data for controlling corresponding subpixels to turn off and/or to remain turned off (without emitting light).

The data matcher 520 may extract the red image data and the blue image data from a data portion a, excluding the green image data in the portion a, to generate 3×3 RB image data illustrated in FIG. 13. The 3×3 RB image data may match the pattern of at least the pattern mask illustrated in FIG. 11A. The center data of the 3×3 RB image data extracted from the data portion a is for controlling a red subpixel in an even-numbered subpixel row. Therefore, the even-numbered line rendering filter 514 may be applied to perform a rendering process on the 3×3 RB image data extracted from the data portion a. With the even-numbered line rendering filter 514, the scale coefficient corresponding to the first-column-center data of the 3×3 RB image data may be set to 1. Therefore, the blue image data that is the first-column-center data of the 3×3 RB image data is multiplied by the scale coefficient 1 and therefore remains turn-off data, such that the corresponding blue subpixel may be turned off or may remain turned off. The red image data that is the center data of the 3×3 RB image data is multiplied by a scale coefficient 0 and is therefore changed from turn-on data to turn-off data, such that the corresponding red subpixel may be turned off or may remain turned off.

Subsequently, the data matcher 520 may extract the red image data and the blue image data from a data portion a', excluding the green image data in the data portion a', to generate 3×3 RB image data illustrated in FIG. 14.

The center data of the 3×3 RB image data extracted from the data portion a' is for controlling a blue subpixel in an even-numbered subpixel row. Therefore, the even-numbered line rendering filter 514 may be applied to perform a rendering process on the 3×3 RB image data extracted from the data portion a'. The red image data that is the first-column-center data of the 3×3 RB image data extracted from the data portion a' is the center data of the 3×3 RB image data extracted from the data portion a and has been changed to turn-off data given the rendering process discussed with reference to FIG. 13. Referring to FIG. 14, the red image data that is the first-column-center data of the 3×3 RB image data extracted from the data portion a' is multiplied by the scale coefficient 1 and therefore remains turn-off data, such that the corresponding red subpixel may be/remain turned off. The blue image data that is the center data of the 3×3 RB image data is multiplied by a scale coefficient 0 and is therefore changed from turn-off data to turn-on data, such that the corresponding blue subpixel may be/remain turned on and/or may emit light.

The data matcher 520 may extract the red image data and the blue image data from a data portion b, excluding the green image data in the data portion b, to generate 3×3 RB image data illustrated in FIG. 15.

The center data of the 3×3 RB image data extracted from the data portion b is for controlling a red subpixel in an odd-numbered subpixel row. Therefore, the odd-numbered line rendering filter 513 may be applied to perform a rendering process on the 3×3 RB image data extracted from the data b. With the odd-numbered line rendering filter 513, the scale coefficient corresponding to the center data of the 3×3 RB image data is set to 1. Therefore, the red image data that is the center data of the 3×3 RB image data is multiplied by the scale coefficient 1 and therefore remains turn-on data, such that the corresponding blue subpixel may be/remain turned on and/or may emit light.

Analogous rendering processes may be performed on other data portions of the RGBG image data illustrated in FIG. 12. The rendering process performed through the common rendering filter 512 may be substantially identical to or analogous to the rendering process performed through the odd-numbered line rendering filter 513.

After a rendering process (which may include rendering processes for different data portions) for the red image data and blue image data of the RGBG image data illustrated in FIG. 12 has been performed through the common rendering filter 512, the odd-numbered line rendering filter 513, and the even-numbered line rendering filter 514 and after the green image data has been restored, the RGBG image data illustrated in FIG. 16 may be resulted.

According to the RGBG image data illustrated in FIG. 16, in each subpixel row, a green subpixel associated with the diagonal line to be displayed, i.e., the green subpixel positioned closer to the location of the diagonal line than any other green subpixels in the subpixel row, is controlled to be/remain turned on and/or to emit light. According to the RGBG image data illustrated in FIG. 16, in even-numbered subpixel rows, the blue subpixels that immediately neighbor the green subpixels associated with the diagonal line may emit light, and the red subpixels that immediately neighbor the green subpixels associated with the diagonal line may not emit light. In odd-numbered subpixel rows, the red subpixels that immediately neighbor the green subpixels associated with the diagonal line may emit light, and the blue subpixels that immediately neighbor the green subpixels associated with the diagonal line may not emit light. Therefore, the diagonal line is displayed using the red light emitted by the red subpixels, the green light emitted by the green subpixels, and the blue light emitted by the blue subpixels. Since the diagonal line is displayed using a combination of red light, green light, and blue light, the diagonal may be substantially white. Advantageously, a substantially white diagonal line may be displayed without substantial color distortion.

Figure 17:
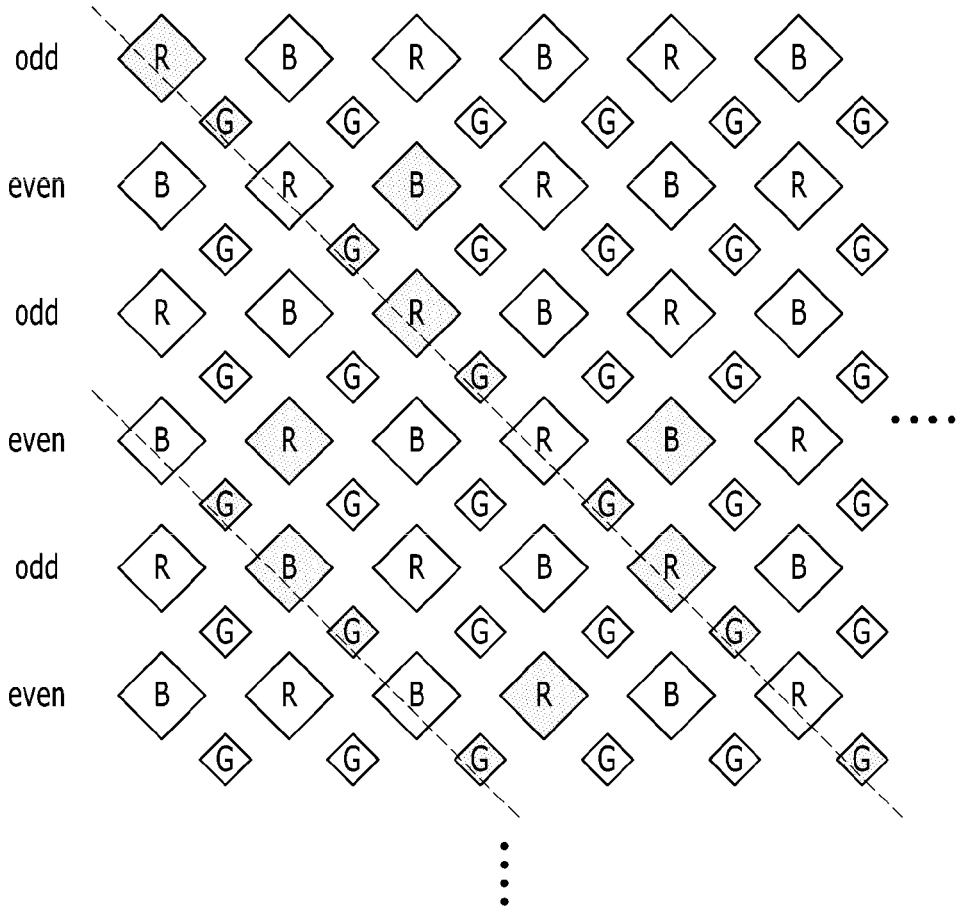
FIG. 17 illustrates resulted RGBG image data after a rendering process has been performed on RGBG image data for displaying a diagonal line illustrated in FIG. 9 according to an embodiment of the present invention.

FIG. 17 illustrates resulted RGBG image data after a rendering process has been performed on RGBG data for displaying a diagonal line illustrated in FIG. 9 according to an embodiment of the present invention.

According to the RGBG image data illustrated in FIG. 17, in each green subpixel row, a green subpixel associated with the diagonal line to be displayed, i.e., the green subpixel positioned closer to the location of the diagonal line than any other green subpixels in the green subpixel row, is controlled to be/remain turned and/or to emit light. According to the RGBG image data illustrated in FIG. 17, in each even-numbered red-blue subpixel row, the blue subpixel that immediately neighbors the green subpixel associated with the diagonal line may emit light, and the red subpixel that immediately neighbors the green subpixel associated with the diagonal line may not emit light. In each odd-numbered red-blue subpixel row, the red subpixel that immediately neighbors the green subpixel associated with the diagonal line may emit light, and the blue subpixel that immediately neighbors the green subpixel associated with the diagonal line may not emit light. Therefore, the diagonal line is displayed using the red light emitted by the red subpixels, the green light emitted by the green subpixels, and the blue light emitted by the blue subpixels. Since the diagonal line is displayed using a combination of red light, green light, and blue light, the diagonal may be substantially white. Advantageously, a substantially white diagonal line may be displayed without substantial color distortion.

Figure 18:
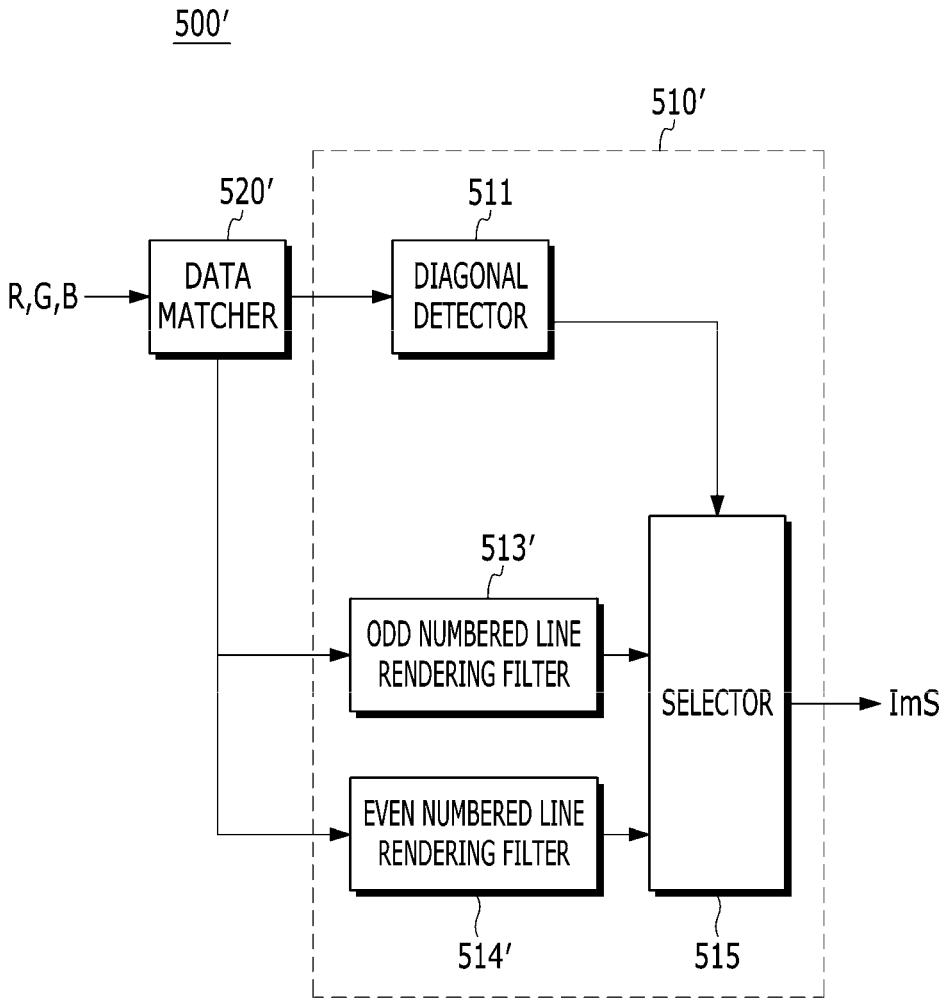
FIG. 18 illustrates a data processing apparatus according to an embodiment of the present invention.

FIG. 18 is a block diagram illustrating a data processing apparatus 500' according to an embodiment of the present invention. The display device 10 (illustrated in FIG. 1) may include the data processing apparatus 500', in addition to or alternative to the data processing apparatus 500 illustrated in FIG. 1 and FIG. 10. One or more features of the data processing apparatus 500' may be identical to or analogous to one or more features of the data processing apparatus 500.

Referring to FIG. 18, the data processing apparatus 500' includes rendering unit 510 (e.g., an 8 color rendering unit 510') and a data matcher 520'.

The data matcher 520' may receive RGB image data (R,G, B) and may match (and/or map) the RGB image data (R,G,B) to subpixels of the four-subpixel pixel layout structure of a display unit, e.g., the display unit 600. The RGB image data corresponding to 6 subpixels (i.e., a first red subpixel, a first green subpixel, a first blue subpixel, a second red subpixel, a second green subpixel, and a second blue pixel) may be converted into RGBG image data corresponding to 4 subpixels (i.e., a red subpixel, a first green subpixel, a blue subpixel, and a second green subpixel) through the data matcher 520'.

The data matcher 520' may convert data values of each of the red image data and the blue image data included in the RGBG image data into 0 or 1. The data matcher 520' may compare the grayscale value of each of the red image data and the blue image data with a threshold value, may convert image data having a grayscale value equal to or larger than the threshold value into 1, and may convert image data having a grayscale value smaller than the threshold value into 0. Accordingly, power consumption and/or computational amount during the rendering process may be reduced.

The data matcher 520' may provide 3×3 RB image data to the diagonal detector 511. The 3×3 RB image data may include 1 bit red image data and 1 bit blue image data each having a value of 0 or 1. The data matcher 520' may provide 1×3 RB image data that includes 1 bit red image data and 1 bit blue image data each having a value of 0 or 1 to each of an odd-numbered line rendering filter 513' and an even-numbered line rendering filter 514'. Additionally or alternatively, the data matcher 520' may provide 1×3 RB image data that includes red image data and blue image data each having a grayscale value to each of the odd-numbered line rendering filter 513' and the even-numbered line rendering filter 514'.

The 8 color rendering unit 510' may include the diagonal detector 511, the odd-numbered line rendering filter 513', the even-numbered line rendering filter 514', and a selector 515.

The diagonal detector 511 may receive the 3×3 RB image data from the data matcher 520. The 3×3 RB image data received from the data matcher 520 may include 1 bit red image data and 1 bit blue image data each having a value of 0 or 1. The diagonal detector 511 may include a plurality of pattern masks (illustrated in FIGS. 11A to 11S) for recognizing image data for displaying a diagonal line. The diagonal detector 511 may determine whether the 3×3 RB image data represents (and/or includes) data for displaying a diagonal line by matching and/or compare the 3×3 RB image data with the plurality of pattern masks. The diagonal detector 511 may determine whether the center data of the 3×3 RB image data is data for controlling a subpixel in an odd-numbered subpixel line or for controlling a subpixel in an even-numbered subpixel line. The diagonal detector 511 may provide line information and diagonal information to the selector 515. The line information may indicate whether the center data of the 3×3 RB image data is for controlling a subpixel in an odd-numbered subpixel line or in an even-numbered subpixel line. The diagonal information may indicate whether the 3×3 RB image data represents (and/or includes) data for displaying a diagonal line.

The odd-numbered line rendering filter 513' may perform a rendering process by applying scale coefficients to the 1×3 RB image data. In an embodiment, the scale coefficient corresponding to the center data of the 1×3 RB image data may be set to 1, and the scale coefficient corresponding to the remaining data of the 1×3 RB image data may be set to 0. The center data of the 1×3 RB image data may be output through the odd-numbered line rendering filter 513'.

The even-numbered line rendering filter 514' may perform a rendering process by applying scale coefficients to the 1×3 RB image data. In an embodiment, the scale coefficient corresponding to the first-column data of the 1×3 RB image data may be set to 1, and the scale coefficient corresponding to the remaining data of the 1×3 RB image data may be set to 0. That is, the scale coefficient 1 is applied to the leftmost image data of the 1×3 RB image data, and the scale coefficient 0 is applied to the remaining data of the 1×3 RB image data. The first-column data of the 1×3 RB image data is output through the even-numbered line rendering filter 514'.

The data matcher 520' may extract the 3×3 RB image data corresponding to red subpixels and blue subpixels included in the display unit 600 and may provide the 3×3 RB image data to the diagonal detector 511. The data matcher 520' may extract the 1×3 RB image data and may provide a copy of the 1×3 RB image data to each of the odd-numbered line rendering filter 513' and the even-numbered line rendering filter 514'. The center data of the 1×3 RB image data may be equal to the center data of the 3×3 RB image data.

The selector 515 may select one of the processed image data provided by the odd-numbered line rendering filter 513' and the processed image data provided by the even-numbered line rendering filter 514' according to the diagonal information and the line information. If the line information indicates that the center data of the 3×3 RB image data is for controlling a subpixel in an odd-numbered subpixel line, the selector 515 may select the processed image data provided by the odd-numbered line rendering filter 513'. If the line information indicates that the center data of the 3×3 RB image data is for controlling a subpixel in an even-numbered subpixel line and if the diagonal information indicates that the 3×3 RB image data represents (and/or includes) data for displaying a diagonal line, the selector 515 may select the processed image data provided by the even-numbered line rendering filter 514'. If the line information indicates that the center data of the 3×3 RB image data is for controlling a subpixel in an even-numbered subpixel line and if the diagonal information indicates that the 3×3 RB image data does not represent (and/or include) data for displaying a diagonal line, the selector 515 may select the processed image data provided by the odd-numbered line rendering filter 513'.

The selector 515 may convert the selected image data into having the minimum grayscale value (e.g., "00000000") if the value of the selected image data is 0, and the selector 515 may convert the selected image data into having the maximum grayscale value (e.g., "11111111") if the value of the selected image data is 1. The green image data corresponding to green subpixels included in the display unit 600 may be transferred from the data matcher 520' to the selector 515 without undergoing a rendering process.

The selector 515 may generate the RGBG subpixel data ImS by adding the green image data to the processed red image data and the processed blue image data.

Examples of rendering processes of 1×3 RB image data performed through the odd-numbered line rendering filter 513' and the even-numbered line rendering filter 514' are described with reference to FIGS. 19 to 22.

Figure 19:
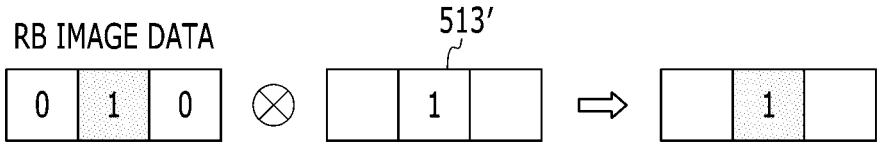
FIG. 19 illustrates a rendering process performed by a data processing apparatus according to an embodiment of the present invention.
Figure 20:
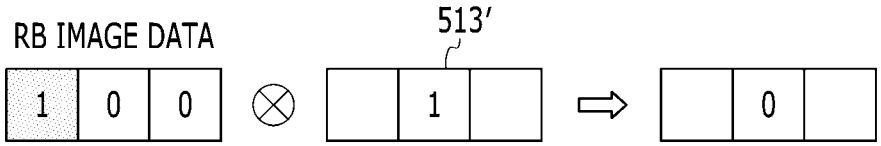
FIG. 20 is a block diagram illustrates a rendering process performed by a data processing apparatus according to an embodiment of the present invention.
Figure 21:
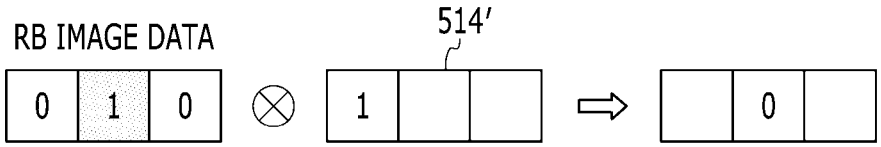
FIG. 21 illustrates a rendering process performed by a data processing apparatus according to an embodiment of the present invention.
Figure 22:
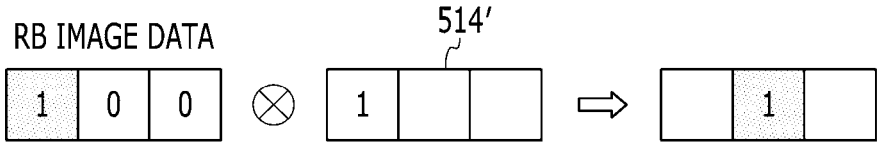
FIG. 22 illustrates a rendering process performed by a data processing apparatus according to an embodiment of the present invention.

FIG. 19 illustrates a rendering process performed by a data processing apparatus according to an embodiment of the present invention. FIG. 20 illustrates a rendering process performed by a data processing apparatus according to an embodiment of the present invention. FIG. 21 illustrates a rendering process performed by a data processing apparatus according to an embodiment of the present invention. FIG. 22 illustrates a rendering process performed by a data processing apparatus according to an embodiment of the present invention.

FIGS. 19 and 20 illustrate rendering processes performed through the odd-numbered line rendering filter 513'. In the odd-numbered line rendering filter 513', the scale coefficient corresponding to the center data of the 1×3 RB image data may be set to 1, and the scale coefficient corresponding to the remaining data of the 1×3 RB image data may be set to 0.

As shown in FIG. 19, if the 1×3 RB image data is represented by 010, the center data 1 of the 1×3 RB image data is multiplied by the scale coefficient 1, and the resulted center data value 1 is output.

As shown in FIG. 20, if the 1×3 RB image data is represented by 100, the center data 0 of the 1×3 RB image data is multiplied by the scale coefficient 1, and the resulted center data value 0 is output.

FIGS. 21 and 22 illustrate rendering processes performed through the even-numbered line rendering filter 514'. In the even-numbered line rendering filter 514', the scale coefficient corresponding to the first-column (i.e., leftmost) data of the 1×3 RB image data may be set to 1, and the scale coefficient corresponding to the remaining data of the 1×3 image data may be set to 0.

As shown in FIG. 21, if the 1×3 RB image data is represented by 010, the center data 1 of the 1×3 RB image data is multiplied by the scale coefficient 0, and the resulted center data value 0 is output.

As shown in FIG. 22, if the 1×3 RB image data is represented by 100, the center data 0 of the 1×3 RB image data is multiplied by the scale coefficient 0 and therefore changes from turn-off data to turn-on data, and the resulted center data value 1 is output.

The resulted center data values discussed with reference to FIGS. 19 to 22 may be used for controlling subpixels in one or more methods analogous to one or more of the methods described with reference to FIGS. 12 to 17.

The accompanying drawings and detailed description of the present invention are for describing embodiments of the present invention. Those skilled in the art will understand that various modifications can be made, and other embodiments are available. The scope of the present invention should be determined by the appended claims.

DESCRIPTION OF SYMBOLS

10: display device
100: signal controller
200: scan driver
300: data driver
400: power supply unit
500, 500': data processing apparatus
510: 8 color rendering unit
511: diagonal detector
512: common rendering filter
513, 513': odd-numbered line rendering filter
514, 514': even-numbered line rendering filter
515: selector
520, 520': data matcher
530: 8 color converter

What is claimed is:

1. A data processing apparatus comprising:

a diagonal detector configured to determine whether a first red-blue data set includes data for controlling a display device to display any diagonal line that substantially overlaps or is substantially parallel to a diagonal of a display area of the display device, the display device including subpixels arranged in first-type subpixel lines and second-type subpixel lines that are alternately disposed, the first red-blue data set including first 9 data values that correspond to first 9 subpixels among the subpixels, the first 9 subpixels forming a first 3-by-3 array and including red subpixel and blue pixels, the first 3-by-3 array including a first center subpixel located at center of the first 3-by-3 array, the first 9 data values including a first center data value that corresponds to the first center subpixel;

a first processor configured to process the first center data value using a first coefficient to produce a first first-type line center data value that corresponds to the first center subpixel if the first center subpixel is in the first-type subpixel lines;

a second processor configured to process the first center data value using a second coefficient different from the first coefficient to produce a first second-type line center data value that corresponds to the first center subpixel if the first center subpixel is in the second-type subpixel lines; and hardware for performing one or more tasks associated with one of more of the diagonal detector, the first processor, and the second processor.

2. The data processing apparatus of claim 1, further comprising: a third processor configured to process the first center data value to produce a first processed center data value that corresponds to the first center subpixel if the diagonal detector determines that the first red-blue data set does not include data for displaying any diagonal line.

3. The data processing apparatus of claim 1, wherein the first processor is configured to multiply the first center data value by 1 to produce the first first-type line center data value, and wherein the second processor is configured to multiply the first center data value by 0 to produce the first second-type line center data value.

4. The data processing apparatus of claim 3, wherein the first 3-by-3 array further includes a first neighbor subpixel located at a center of a first column of the first 3-by-3 array or located at a center of a first row of the first 3-by-3 array, wherein the first 9 data values further including a first neighbor data value that corresponds to the first neighbor subpixel, wherein the first processor is configured to multiply the first neighbor data value by 0 to produce a first first-type line neighbor data value that corresponds to the first neighbor subpixel if the first center subpixel and the first neighbor subpixel are in the first-type subpixel lines, and wherein the second processor is configured to multiply the first neighbor data value by 1 to produce a first second-type line neighbor data value that corresponds the first neighbor subpixel if the first center subpixel and the first neighbor subpixel are in the second-type subpixel lines.

5. The data processing apparatus of claim 4, wherein the first 3-by-3 array further includes a first adjacent subpixel located at a center of a third column of the first 3-by-3 array or located at a center of a third row of the first 3-by-3 array, wherein the first 9 data values further includes a first adjacent data value that corresponds to the first adjacent subpixel, and wherein at least one of the first processor and the second processor is configured to multiply the first adjacent data value by 0 to produce a first first-type line adjacent data value that corresponds to the first adjacent subpixel.

6. The data processing apparatus of claim 4, wherein at least one of the first processor and the second processor is further configured to multiply each of 7 data values of the first 9 data values other than the first center data value and the first neighbor data value by 0 to produce 7 processed data values that correspond to 7 subpixels of the first 3-by-3 subpixel array other than the first center subpixel and the first neighbor subpixel.

7. The data processing apparatus of claim 4, further comprising: a third processor configured to process the first center data value and the first neighbor data to produce a first processed center data value and a first processed neighbor data value that correspond to the first center subpixel and the first neighbor subpixel, respectively, if the diagonal detector determines that the first red-blue data set does not include data for displaying any diagonal line.

8. The data processing apparatus of claim 7, wherein the third processor is configured to multiply the first center data value by 1 to produce the first processed center data value, and wherein the third processor is configured to multiply the first neighbor data value by 0 to produce the first processed neighbor data value.

9. The data processing apparatus of claim 1, wherein the data processing apparatus is configured to output the first first-type line center data value or a value generated based on the first first-type line center data value for controlling the center subpixel if the first center subpixel is in the first-type subpixel lines or if the diagonal detector determines that the first red-blue data set is not for displaying any diagonal line, and wherein the data processing apparatus is configured to output the second first-type line center data value or a value generated based on the first second-type line center data value for controlling the center subpixel if the first center subpixel is in the second-type subpixel lines and if the diagonal detector determines that the first red-blue data set is for displaying a diagonal line.

10. The data processing apparatus of claim 1, further comprising a data matcher configured to form the first red-blue data set based on a red-green-blue data set, the data matcher being further configured to form a second red-blue data set based on the red-green-blue data set, the second red-blue data set including second 9 data values that correspond to second 9 subpixels among the subpixels, the second 9 subpixels forming a second 3-by-3 array, the second 3-by-3 array including a second center subpixel located at a center of the second 3-by-3 array, the second 3-by-3 array further including a second neighbor subpixel located at a center of a first column of the second 3-by-3 array or located at a center of a first row of the second 3-by-3 array, the second 9 data values including a second center data value and a second neighbor data value that correspond to the second center subpixel and the second neighbor subpixel, respectively, the second neighbor subpixel being the first center subpixel.

11. The data processing apparatus of claim 10, wherein the second neighbor data value is equal to the first first-type line center data value or the first second-type line center data value, wherein the first processor is configured to multiply the first first-type line center data value by 0 to produce a second first-type line neighbor data value that corresponds to the second neighbor subpixel if the second center subpixel and the second neighbor subpixel are in the first-type subpixel lines, and wherein the second processor is configured to multiply the first second-type line center data value by 1 to produce a second second-type line neighbor data value that corresponds the second neighbor subpixel if the second center subpixel and the second neighbor subpixel are in the second-type subpixel lines.

12. A display device comprising:

a display unit that includes a plurality of subpixels disposed in a display area, the subpixels including red subpixels, green subpixels, and blue subpixels arranged in first-type subpixels lines and second-type subpixel lines that are alternately disposed, the first-type subpixel lines including a first first-type subpixel line, the second-type subpixel lines including a first second-type subpixel line that immediately neighbors the first first-type subpixel line;

a data processing apparatus configured to provide data values for controlling at least a portion of the subpixels to display a diagonal line at a diagonal line location, the diagonal line substantially overlapping or being substantially parallel to a diagonal of the display area; and hardware for performing one or more tasks associated with at least one of the display unit and the data processing apparatus, wherein the data values are configured for controlling the portion of the subpixels such that a first green subpixel arranged in the first first-type subpixel line and located at the diagonal line location is configured to emit light for display of the diagonal line, a first blue subpixel immediately neighboring the first green subpixel is configured to emit light for the display of the diagonal line, a first red subpixel immediately neighboring the first green subpixel is configured not to emit light for the display of the diagonal line, a second green subpixel arranged in the first second-type subpixel line and located at the diagonal line location is configured to emit light for the display of the diagonal line, a second blue subpixel immediately neighboring the second green subpixel is configured not to emit light for the display of the diagonal line, and a second red subpixel immediately neighboring the second green subpixel is configured to emit light for the display of the diagonal line.

13. The display device of claim 12, wherein the first blue subpixel and the first red subpixel are arranged in the first first-type subpixel line, wherein the first green subpixel is disposed between the first blue subpixel and the first red subpixel, wherein the second blue subpixel and the second red subpixel are arranged in the first second-type subpixel line, and wherein the second green subpixel is disposed between the second blue subpixel and the second red subpixel.

14. The display device of claim 12, wherein the first first-type subpixel line includes a blue-red subpixel line and a first green subpixel line, wherein the first second-type subpixel line includes a red-blue subpixel line and a second green subpixel line, wherein the first blue subpixel and the first red subpixel are arranged in the blue-red subpixel line, wherein the first green subpixel is positioned between the first blue subpixel and the first red subpixel, wherein the second blue subpixel and the second red subpixel are arranged in the red-blue subpixel line, and wherein the second green subpixel is positioned between the second blue subpixel and the second red subpixel.

15. The display device of claim 12, wherein the data processing apparatus comprises:

a diagonal detector configured to determine whether a red-blue data set includes data for displaying any diagonal line, the red-blue data set including 9 data values that correspond to 9 subpixels among the subpixels, the 9 subpixels forming a 3-by-3 array and including a portion of the red subpixel and a portion of the blue pixels, the 3-by-3 array including a center subpixel located at center of the 3-by-3 array, the 9 data values including a center data value that corresponds to the center subpixel;

a first processor configured to process the center data value using a first coefficient to produce a first-type line center data value that corresponds to the center subpixel if the center subpixel is in the first-type subpixel lines;

a second processor configured to process the center data value using a second coefficient different from the first coefficient to produce a second-type line center data value that corresponds to the center subpixel if the center subpixel is in the second-type subpixel lines, wherein the data values include a data value generated based on at least one of the first-type line center data value and the second-type line center data value.

16. A method for controlling a display device to display a diagonal line at a diagonal line location, the display device including a plurality of subpixels disposed in a display area, the subpixels including red subpixels, green subpixels, and blue subpixels arranged in first-type subpixels lines and second-type subpixel lines that are alternately disposed, the first-type subpixel lines including a first first-type subpixel line, the second-type subpixel lines including a first second-type subpixel line that immediately neighbors the first first-type subpixel line, the method being performed using hardware and comprising:

controlling a first green subpixel arranged in the first first-type subpixel line and located at the diagonal line location to emit light for display of the diagonal line;

controlling a first blue subpixel immediately neighboring the first green subpixel to emit light for the display of the diagonal line;

controlling a first red subpixel immediately neighboring the first green subpixel not to emit light for the display of the diagonal line;

controlling a second green subpixel arranged in the first second-type subpixel line and located at the diagonal line location to emit light for the display of the diagonal line;

controlling a second blue subpixel immediately neighboring the second green subpixel not to emit light for the display of the diagonal line; and controlling a second red subpixel immediately neighboring the second green subpixel to emit light for the display of the diagonal line.

17. The method of claim 16, wherein the first blue subpixel and the first red subpixel are arranged in the first first-type subpixel line, wherein the first green subpixel is disposed between the first blue subpixel and the first red subpixel, wherein the second blue subpixel and the second red subpixel are arranged in the first second-type subpixel line, and wherein the second green subpixel is disposed between the second blue subpixel and the second red subpixel.

18. The method of claim 16, wherein the first first-type subpixel line includes a blue-red subpixel line and a first green subpixel line, wherein the first second-type subpixel line includes a red-blue subpixel line and a second green subpixel line, wherein the first blue subpixel and the first red subpixel are arranged in the blue-red subpixel line, wherein the first green subpixel is positioned between the first blue subpixel and the first red subpixel, wherein the second blue subpixel and the second red subpixel are arranged in the red-blue subpixel line, and wherein the second green subpixel is positioned between the second blue subpixel and the second red subpixel.

19. The method of claim 16, further comprising:

determining whether a red-blue data set includes data for displaying any diagonal line, the red-blue data set including 9 data values that correspond to 9 subpixels among the subpixels, the 9 subpixels forming a 3-by-3 array and including a portion of the red subpixel and a portion of the blue pixels, the 3-by-3 array including a center subpixel located at center of the 3-by-3 array, the 9 data values including a center data value that corresponds to the center subpixel;

processing the center data value using a first coefficient to produce a first-type line center data value that corresponds to the center subpixel if the center subpixel is in the first-type subpixel lines;

processing the center data value using a second coefficient different from the first coefficient to produce a second-type line center data value that corresponds to the center subpixel if the center subpixel is in the second-type subpixel lines; and processing at least one of the first-type line center data value and the second-type line center data value to generate a control data value for controlling at least one of the first blue subpixel and the first red subpixel.

20. The method of claim 19, wherein the 3-by-3 array further includes a neighbor subpixel located at a center of a first column of the 3-by-3 array or located at a center of a first row of the 3-by-3 array, wherein the first 9 data values further including a neighbor data value that corresponds to the neighbor subpixel, wherein the method further comprises processing the neighbor data value using the second coefficient to produce a first-type line neighbor data value that corresponds to the neighbor subpixel if the center subpixel and the neighbor subpixel are in the first-type subpixel lines, and wherein the method further comprises processing the neighbor data using the first coefficient to produce a second-type line neighbor data value that corresponds the neighbor subpixel if the center subpixel and the neighbor subpixel are in the second-type subpixel lines.

* * * * *